US006290789B1

(12) United States Patent
Toyooka et al.

(10) Patent No.: US 6,290,789 B1
(45) Date of Patent: Sep. 18, 2001

(54) ULTRAFINE-GRAIN STEEL PIPE AND PROCESS FOR MANUFACTURING THE SAME

(75) Inventors: Takaaki Toyooka; Akira Yorifuji; Masanori Nishimori; Motoaki Itadani; Yuji Hashimoto; Takatoshi Okabe; Taro Kanayama, all of Aichi; Masahiko Morita; Saiji Matsuoka, both of Okayama; Nobuki Tanaka, Aichi; Osamu Furukimi; Takaaki Hira, both of Chiba, all of (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/254,024

(22) PCT Filed: Jun. 24, 1998

(86) PCT No.: PCT/JP98/02811

§ 371 Date: Feb. 26, 1999

§ 102(e) Date: Feb. 26, 1999

(87) PCT Pub. No.: WO99/00525

PCT Pub. Date: Jan. 7, 1999

(30) Foreign Application Priority Data

| | | |
|---|---|---|
| Jun. 26, 1997 | (JP) | 9-170790 |
| Jul. 22, 1997 | (JP) | 9-196038 |
| Aug. 20, 1997 | (JP) | 9-223315 |
| Aug. 25, 1997 | (JP) | 9-228579 |
| Sep. 5, 1997 | (JP) | 9-240930 |
| May 15, 1998 | (JP) | 10-133933 |

(51) Int. Cl.[7] ..... C21D 9/08

(52) U.S. Cl. ..... 148/593; 148/648; 148/654

(58) Field of Search ..... 148/593, 648, 148/654; 420/124, 126, 127

(56) References Cited

U.S. PATENT DOCUMENTS 4,631,095 * 12/1986 Von Hagen et al. ..... 148/12
5,080,727 * 1/1992 Aihara et al. ..... 148/11.5

FOREIGN PATENT DOCUMENTS 05-059434 * 3/1993 (JP) .
05-070831 * 3/1993 (JP) .

* cited by examiner

*Primary Examiner*—George Wyszomierski
*Assistant Examiner*—Janelle Combs-Morillo
(74) *Attorney, Agent, or Firm*—Young & Thompson

(57) ABSTRACT

A steel pipe containing fine ferrite crystal grains, which has excellent toughness and ductility and good ductility-strength balance as well as superior collision impact resistance, and a method for producing the same are provided. A steel pipe containing super-fine crystal grains can be produced by heating a base steel pipe having ferrite grains with an average crystal diameter of di ($\mu$m), in which C, Si, Mn and Al are limited within proper ranges, and if necessary, Cu, Ni, Cr and Mo, or Nb, Ti, V, B, etc. are further added, at not higher than the $Ac_3$ transformation point, and applying reducing at an average rolling temperature of θm (°C.) and a total reduction ration Tred (%) within s temperature range of from 400 to $Ac_3$ transformation point, with di, θm and Tred being in a relation satisfying a prescribed equation.

16 Claims, 7 Drawing Sheets

0.5μm 0.5μm

ULTRAFINE-GRAIN STEEL PIPE AND PROCESS FOR MANUFACTURING THE SAME

TECHNICAL FIELD OF THE INVENTION

The present invention relates to a steel pipe containing super-fine crystal grains, which has excellent strength, toughness and ductility and superior collision impact resistance and a method for producing the same.

BACKGROUND ART

The strength of steel materials have been increased heretofore by adding alloying elements such as Mn and Si, and by utilizing, for instance, controlled rolling, controlled cooling, thermal treatments such as quenching and tempering, or by adding precipitation hardening elements such as Nb and V. In the case of a steel material, however, not only strength but also high ductility and toughness are required. Hence, a steel material with balanced strength and ductility as well as toughness has been demanded.

The reduction in crystal size is important in that it is one of the few means for increasing not only strength, but also both of ductility and toughness at the same time. Crystal grains sufficiently reduced in size can be realized by, for example, a method which comprises preventing coarsening of austenite grains and obtaining fine ferritic crystal grains from fine austenite grains by utilizing the austenite-ferrite transformation; a method which comprises obtaining fine ferrite grains from fine austenite grains realized by working; or a method which comprises utilizing martensite or lower bainite resulting from quenching and tempering.

In particular, controlled rolling comprising intense working in the austenitic region and reducing size of ferrite grains by using the subsequent austenite - ferrite transformation is widely utilized for the production of steel materials. Furthermore, a method for further reducing the size of ferrite grains by adding a trace amount of Nb and thereby suppressing the recrystallization of austenite grains is also known in the art. By working in a temperature in the non-recrystallizing temperature region, austenite grains grow as to form a transgranular deformation band, and ferrite grains generate from the deformation band as to further reduce the size of the ferrite grains. Furthermore, controlled cooling which comprises cooling during or after working is also employed.

However, the fine grains available by the methods above have lower limits in the grain size of about 4 to 5 $\mu$m. Furthermore, the methods are too complicated to be applied to the production of steel pipes. In the light of such circumstances, a method comprising simple process steps and yet capable of further reducing the grain size of ferrite crystals for improving the toughness and ductility of steel pipes has been required. Moreover, concerning the recent increasing demand for steel pipes having superior collision impact resistances to achieve the object of improving safety of automobiles, limits in cutting cost has been found so long as the methods enumerated above are employed, because they required considerable modification in process steps inclusive of replacing the equipment and the like.

Furthermore, the improvement in resistances against sulfide stress corrosion cracks of steel pipes for use in line pipes, at present, hardness control is performed to lower the concentration of impurities and control the concentration of alloy elements.

Conventionally, fatigue resistance has been improved by employing thermal treatments such as quench hardening and tempering, induction hardening, and carburizing, or by adding expensive alloy elements such as Ni, Cr, Mo, etc. in large amounts. However, these methods has problems of impairing the weldability, and furthermore, of increasing the cost.

A high strength steel pipe having a tensile strength of over 600 MPa is produced by using a carbon-rich material containing carbon (C) at a concentration of 0.30% or more, or by a material containing C at a high concentration and other alloy elements added at large quantities. In the case of high strength steel pipes thus increased in strength by methods above, however, the elongation properties tend to be impaired. Thus, in general, the application of intense working is avoided; in case intense working is necessary, intermediate annealing is performed during working, and further thermal treatments such as normalizing, quenching and tempering, etc., is applied. However, the application of additional thermal treatment such as intermediate annealing makes the process complicated.

In the light of the circumstances above, a method which allows intense working of high strength steel pipe without applying intermediate annealing is demanded, and also, further reduction in crystal grains is desired for the improvement in workability of high strength steel pipes.

An object of the present invention is to advantageously solve the problems above, and to provide a steel pipe improved in ductility and collision impact resistance without incorporating considerable change in production process. Another object of the present invention is to provide a method for producing the same steel. Further, another object of the present invention is to provide a steel pipe and a method for producing the same, said steel pipe containing super fine grains having excellent toughness and ductility which are ferrite grains 3 $\mu$m or less in size, preferably, 2 $\mu$m, and more preferably, 1 $\mu$m or less in size.

A still another object of the present invention is to provide a high strength steel pipe containing superfine crystal grains, which is improved in workability and having a tensile strength of 600 MPa or more, and to a method for producing the same.

DISCLOSURE OF THE INVENTION

The present inventors extensively and intensively performed studies on a method of producing high strength steel pipes having excellent ductility, yet at a high production speed. As a result, it has been found that a highly ductile high strength steel pipe having well-balanced strength and ductility properties can be produced by applying reducing to a steel pipe having a specified composition in a temperature range of ferrite recovery or recrystallization.

First, the experimental results from which the present invention is derived are described below.

A seam welded steel pipe ($\phi$42.7 mm D×2.9 mm t) having a composition of 0.09 wt % C—0.40 wt % Si—0.80 wt % Mn—0.04 wt % Al was heated to each of the temperatures in a range of from 750 to 550° C., and reducing was performed by using a reducing mill to obtain product pipes differing in outer diameter in a range of $\phi$ 33.2 to 15.0 mm while setting the output speed of drawing to 200 m/min. After rolling, the tensile strength (TS) and elongation (El) were measured on each of the product pipes, and the relation between elongation and strength was shown graphically as is shown in FIG. 1 (plotted by solid circles in the figure). In the figure, the open circles show the relation between elongation and strength of seam welded steel pipes of differing size which were obtained by welding but without applying rolling.

For the values of elongation (El), a reduced value obtained by the following equation:

$$El=El0\times(\sqrt{(a0/a)})^{0.4}$$

(where, El0 represents the observed elongation, a0 is a value equivalent to 292 $mm^2$, and a represents the cross section area of the specimen ($mm^2$))

Referring to FIG. 1, it can be seen that higher elongation can be obtained if the base steel pipe is subjected to reducing in the temperature range of from 750 to 550° C. as compared with the elongation of an as-welded seam welded steel pipe at the same strength. That is, the present inventors have been found that a high strength steel pipe having good balance in ductility and strength can be obtained by heating a base steel pipe having a specified composition to a temperature range of 750 to 400° C. and applying reducing.

Furthermore, it has been found that the steel pipe produced by the production method above contain fine ferrite grains 3 μm or less in size. To investigate the collision impact resistance properties, the present inventors further obtained the relation between the tensile strength (TS) and the grain size of ferrite while greatly changing the strain rate to 2,000 $s^{-1}$. As a result, it has been found that the tensile strength considerably increases with decreasing the ferrite grain diameter to 3 μm or less, and that the increase in TS is particularly large at the collision impact deformation in case the strain rate is high. Thus, it has been found additionally that the steel pipe having fine ferrite grains exhibits not only superior balance in ductility and strength, but also considerably improved collision impact resistance properties.

The present invention, which enables a super fine granular steel pipe further reduced in grain size to 1 μm or less, provides a method for producing steel comprising heating or soaking a base steel pipe having an outer diameter of ODi (mm) and having ferrite grains with an average crystal diameter of di (μm) in the cross section perpendicular to the longitudinal direction of the steel pipe, and then applying drawing at an average rolling temperature of θm (° C.) and a total reduction ratio Tred (%) to obtain a product pipe having an outer diameter of ODf (mm), wherein, said drawing comprises performing it in the temperature range of 400° C. or more but not more than the heating or soaking temperature, and in such a manner that said average crystal diameter of di (μm), said average rolling temperature of θm (° C.), and said total reduction ratio Tred (%) are in a relation satisfying equation (1) as follows:

$$di\leqq(2.65-0.003\times\theta m)\times10^{\{(0.008+\theta m/50000)\times Tred\}} \quad (1)$$

where, di represents the average crystal diameter of the base steel pipe (μm); θm represents the average rolling temperature (°C.) (=(θ i+θ f)/2; where θ i is the temperature of starting rolling (°C.), and θ f is the temperature of finishing rolling (°C.)); and Tred represents the total reduction ratio (%) (=ODi−ODf)×100/ODi; where, ODi is the outer diameter of the base steel pipe (mm), and ODf is the outer diameter of the product pipe (mm)) In the present invention, the reducing is preferably performed in the temperature range of from 400 to 750° C. It is also preferred that the heating or soaking of the base steel pipe is performed at a temperature not higher than the $Ac_3$ transformation temperature. It is further preferred that the heating or soaking of the base steel pipe is performed at a temperature in a range defined by ($Ac_1$+50° C.) by taking the $Ac_1$transformation temperature as the reference temperature. Furthermore, the drawing is preferably performed under lubrication.

Preferably, the reducing process is set as such that it comprises at least one pass having a reduction ratio per pass of 6%, and that the cumulative reduction ratio is 60% or more.

Furthermore, the method for producing super fine granular steel pipe containing super fine grains having an average grain size of 1 μm or less according to the present invention preferably utilizes a steel pipe containing 0.70 wt % or less of C as the base steel pipe, and it preferably a steel pipe containing by weight, 0.005 to 0.30% C, 0.01 to 3.0% Si, 0.01 to 2.0% Mn, 0.001 to 0.10% Al, and balance Fe with unavoidable impurities. In the present invention, furthermore, the composition above may further contain at least one type selected from one or more groups selected from the groups A to C shown below:

Group A: 1% or less of Cu, 2% or less of Ni, 2% or less of Cr, and 1% or less of Mo;

Group B: 0.1% or less of Nb, 0.5% or less of V, 0.2% or less of Ti, and 0.005% or less of B; and Group C: 0.02% or less of REM and 0.01% or less of Ca.

Additionally, the present inventors have found that, by restricting the composition of the base steel pipe in a proper range, a steel pipe having high strength and toughness and yet having superior resistance against stress corrosion cracks can be produced by employing the above method for producing steel pipes, and that such steel pipes can be employed advantageously as steel pipes for line pipes.

In order to improve the stress corrosion crack resistance properties, conventionally, steel pipes for use in line pipes have been subjected to hardness control comprising reducing the content of impurities such as S or controlling the alloy elements. However, such methods had limits in improving the strength, and had problems of increasing the cost.

By further restricting the composition of the base steel pipe to a proper range, and by applying reducing to the base steel pipe in the ferritic recrystallization region, fine ferrite grains and fine carbides can be dispersed as to realize a steel pipe with high strength and high toughness. At the same time, the alloy elements can be controlled as such to decrease the weld hardening, while suppressing the generation and development of cracks as to improve the stress corrosion crack resistance.

That is, the present invention provides a steel pipe having excellent ductility and collision impact resistance, yet improved in stress corrosion crack resistance by applying drawing under conditions satisfying equation (1) to a base steel pipe containing, by weight, 0.005 to 0.10% C, 0.01 to 0.5% Si, 0.01 to 1.8% Mn, 0.001 to 0.10% Al, and further containing at least, one or more types selected from the group consisting of 0.5% or less of Cu, 0.5% or less of Ni, 0.5% or less of Cr, and 0.5% or less of Mo; or furthermore one or more selected from the group consisting of 0.1% or less of Nb, 0.1% or less of V, 0.1% or less of Ti, and 0.004% or less of B; or further additionally, one or more selected from the group consisting of 0.02% or less of REM and 0.01% or less of Ca; and balance Fe with unavoidable impurities.

Furthermore, the present inventors have found that, by restricting the composition of the base steel pipe in a further proper range, a steel pipe having high strength and toughness, and yet having superior fatigue resistant properties can be produced by employing the above method for producing steel pipes, and that such steel pipes can be employed advantageously as high fatigue strength steel pipes.

By restricting the composition of the base steel pipe to a proper range, and by applying drawing to the base steel pipe in the ferritic recovery and recrystallization region, fine ferrite grains and fine precipitates can be dispersed as to realize a steel pipe with high strength and high toughness. At the same time, the alloy elements can be controlled as such to decrease the weld hardening, while suppressing the generation and development of fatigue cracks as to improve the fatigue resistance properties.

That is, the present invention provides a steel pipe having excellent ductility and collision impact resistance, yet improved in fatigue resistant properties by applying drawing under conditions satisfying equation (1) to abase steel pipe containing, by weight, 0.06 to 0.30% C, 0.01 to 1.5% Si, 0.01 to 2. 0% Mn, 0.001 to 0.10% Al, and balance Fe with unavoidable impurities.

Additionally, it is possible to obtain a high strength steel pipe having excellent workability, characterized in that it has a composition containing, by weight, more than 0.30% to 0.70% C, 0.01 to 2.0% Si, 0.01 to 2.0% Mn, 0.001 to 0.10% Al, and balance Fe with unavoidable impurities, and a texture consisting of ferrite and a second phase other than ferrite accounting for more than 30% in area ratio, with the cross section perpendicular to the longitudinal direction of the steel pipe containing super fine grains of said ferrite having an average crystal grain size of 2 $\mu$m or less; otherwise, with the cross section perpendicular to the longitudinal direction of the steel pipe containing super fine grains of said ferrite having an average crystal grain size of 1 $\mu$m or less.

EXPLANATION OF SYMBOLS

Figure 1:
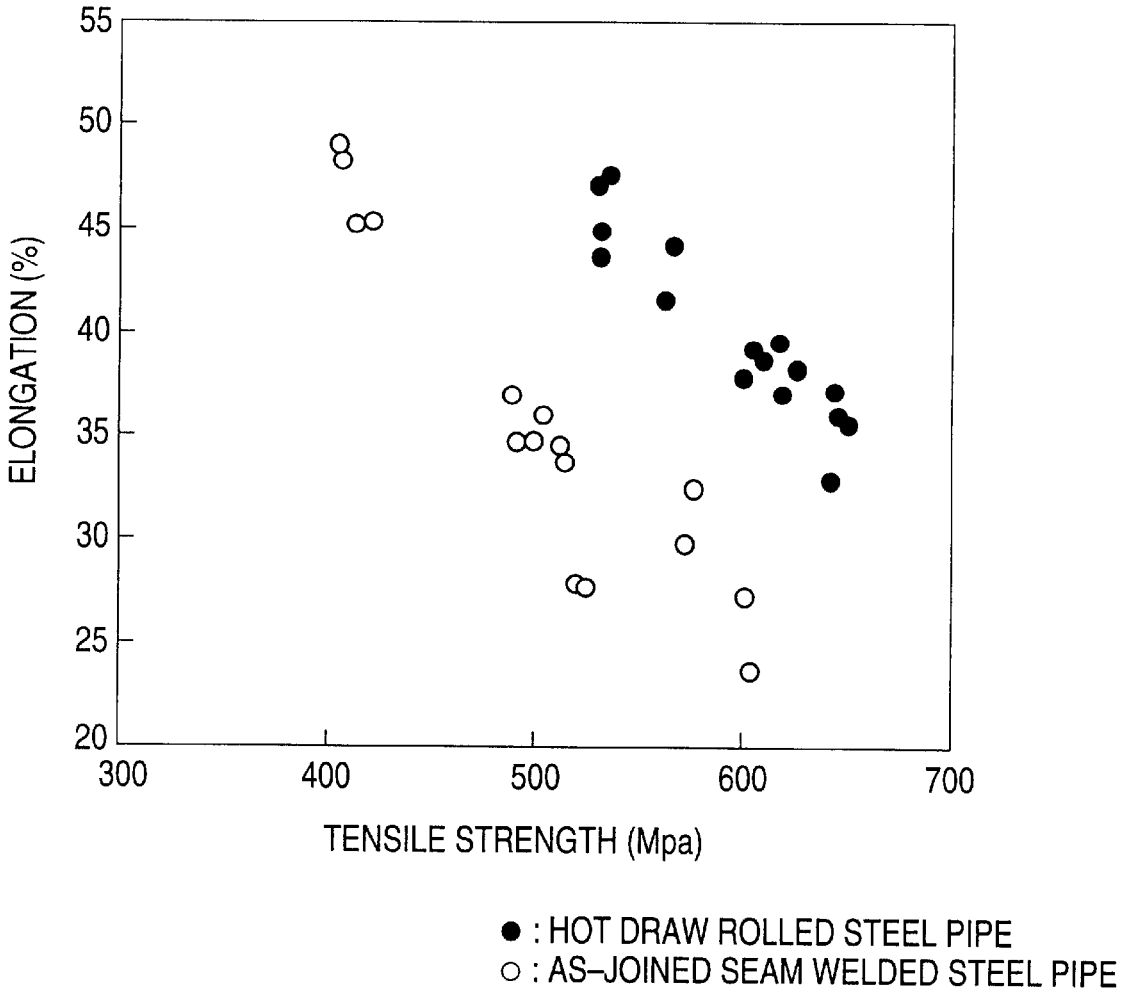
FIG. 1 is a graph showing the relation between elongation and tensile strength of the steel pipe.
Figure 2:
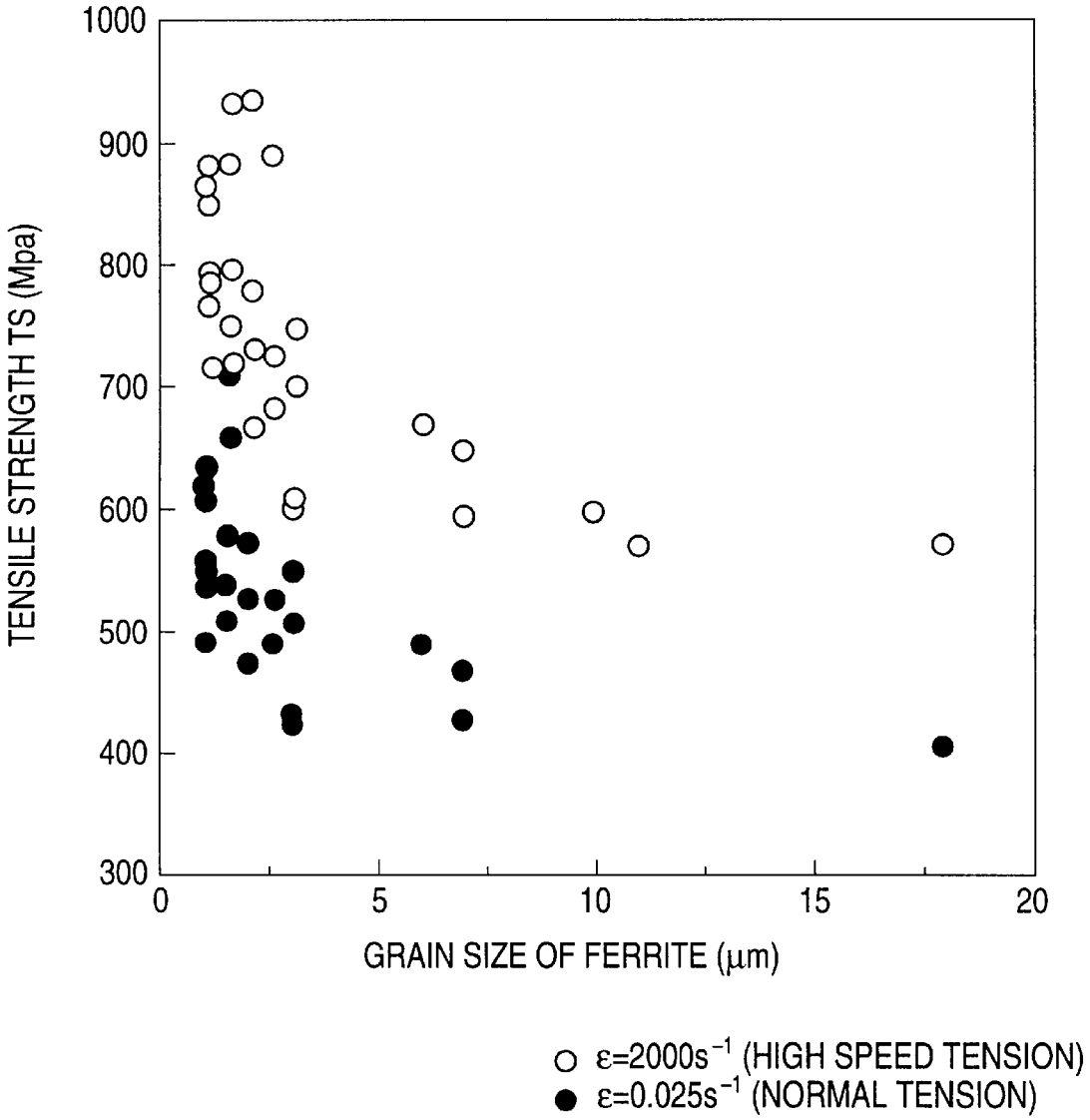
FIG. 2 is a graph showing the influence of tensile strain rate on the relation between the tensile strength and the grain size of ferrite crystals of the steel pipe.

1 Flat strip
2 Pre-heating furnace
3 Forming and working apparatus
4 Induction heating apparatus for pre-heating edges
5 Induction heating apparatus for heating edges
6 Squeeze roll
7 Open pipe
8 Base steel pipe
14 Uncoiler
15 Joining apparatus
16 Product pipe
17 Looper
18 Cutter
19 Pipe straightening apparatus
20 Thermometer
21 Reducing mill
22 Soaking furnace (seam cooling and pipe heating apparatus)
23 Descaling apparatus
24 Quenching apparatus
25 Re-heating apparatus
26 Cooling apparatus

BEST MODE FOR CARRYING OUT THE INVENTION

In the present invention, a steel pipe is used as the starting material. There is no particular limitation concerning the method for producing the base steel pipe. Thus, favorably employable is an electric resistance welded steel pipe (seam welded steel pipe) using electric resistance welding, a solid state pressure welded steel pipe obtained by heating the both edge portions of an open pipe to a temperature region of solid state pressure welding and effecting pressure welding, a forge welded steel pipe, or a seamless steel pipe obtained by using Mannesmann piercer.

The chemical composition of the base steel pipe or product steel pipe is limited in accordance with the following reasons.

C: 0.07% or less:

Carbon is an element to increase the strength of steel by forming solid solution with the matrix or by precipitating as a carbide in the matrix. It also precipitates as a hard second phase in the form of fine cementite, martensite, or bainite, and contributes in increasing ductility (uniform elongation). To achieve a desired strength and to obtain the effect of improved ductility by utilizing cementite and the like precipitated as the second phase, C must be present at a concentration of 0.005% or more, and preferably, 0.04% or more. Preferably, the concentration of C is in a range not more than 0.30%, and more preferably, 0.10% or less. In view of these requirements, the concentration of C is preferably confined in a range of from 0.005 to 0.30%, and more preferably, in a range of from 0.04 to 0.30%.

To improve the stress corrosion crack resistance of the steel pipe to make it suitable for use in line pipes, the concentration of C is preferably controlled to a range of 0.10% or less. If the concentration exceeds 0.10%, the stress corrosion crack resistance decreases due to the hardening of the welded portion.

To improve the fatigue resistance properties of the steel pipe to make it suitable for use as a high fatigue strength steel pipe, the concentration of C is preferably controlled to a range of from 0.06 to 0.30%. If the concentration is lower than 0.06%, the fatigue resistance properties decrease due to insufficiently low strength.

To achieve a desired strength of 600 MPa or more, the concentration of C must exceed 0.30%. However, if C should be incorporated at a concentration exceeding 0.70%, the ductility is inversely impaired. Thus, the concentration of C should be in a range exceeding 0.30% but not more than 0.70%.

Si: 0.01 to 3.0%:

Silicon functions as a deoxidizing element, and it increases the strength of the steel by forming solid solution with the matrix. This effect is observed in case Si is added at a concentration of at 0.01% or more, preferably at 0.1% or more, but an addition in excess of 3.0% impairs ductility.

In case of high strength steel pipe, the upper limit in concentration is set at 2.0% by taking the problem of ductility into consideration. Thus, the concentration of Si is set in a range of from 0.01 to 3.0%, or of from 0.01 to 2.0%. Preferably, however, the range is from 0.1 to 1.5%.

To improve the stress corrosion crack resistance of the steel pipe to make it suitable for use in line pipes, the concentration of Si is preferably controlled to 0.5% or less. If the concentration exceeds 0.5%, the stress corrosion crack resistance decreases due to the hardening of the welded portion.

To improve the fatigue resistance properties of the steel pipe to make it suitable for use as a high fatigue strength steel pipe, the concentration of Si is preferably controlled to 1.5% or less. If the concentration exceeds 1.5%, the fatigue resistance properties decrease due to the formation of inclusions.

Mn: 0.01 to 2.0%:

Manganese increases the strength of steel, and accelerates the precipitation of a second phase in the form of fine cementite, or martensite and bainite. If the concentration is less than 0.01%, not only it becomes impossible to achieve the desired strength, but also fine precipitation of cementite or the precipitation of martensite and bainite is impaired. If the addition should exceed 2.0%, the strength of the steel is excessively increased to inversely impair ductility. Thus, the concentration of Mn is limited in a range of from 0.01 to 2.0%. From the viewpoint of realizing balance strength and elongation, the concentration of Mn is preferably is in a range of from 0.2 to 1.3%, and more preferably, in a range of from 0.6 to 1.3%.

To improve the stress corrosion crack resistance of the steel pipe to make it suitable for use in line pipes, the concentration of Mn is preferably controlled to 1.8% or less. If the concentration exceeds 1.8%, the stress corrosion crack resistance decreases due to the hardening of the welded portion.

Al: 0.001 to 0.10%:

Aluminum provides fine crystal grains. To obtain such fine crystal grains, Al should be added at a concentration of at least 0.001%. However, an addition in excess of 0.10% increases oxygen-containing inclusions which impair the clarity. Thus, the concentration of Al is set in a range of from 0.001 to 0.10%, and preferably, in a range of from 0.015 to 0.06%. In addition to the basic steel composition above, at least one type of an alloy element selected from one or more groups of A to C below may be added.

Group A: Cu: 1% or less, Ni: 2% or less, Cr: 2% or less, and Mo: 1% or less:

Any element selected from the group of Cu, Ni, Cr, and Mo improves the quenching property of the steel, and increase the strength. Thus, one or two or more elements can be added depending on the requirements. These elements lowers the transformation point, and effectively generate fine grains of ferrite or of second phase. However, the upper limit for the concentration of Cu is set at 1%, because Cu incorporated in a large quantity impairs the hot workability. Ni increases not only the strength, but also toughness. However, the effect of Ni saturates at an addition in excess of 2%, and an addition in excess increases the cost. Hence, the upper concentration limit is set at 2%. The addition of Cr or Mo in large quantities not only impairs the weldability, but also increases the total expense. Thus, their upper limits are set to 2% and 1%, respectively.

Preferably, the concentration range for the elements in Group A is from 0.1 to 0.6% for Cu, from 0.1 to 1.0% for Ni, from 0.1 to 1.5% for Cr, and from 0.05 to 0.5% for Mo.

To make the steel pipes useful for line pipes by improving the resistance against stress corrosion cracks, the concentration of Cu, Ni, Cr, and Mo is each restricted to be 0.5% or lower. If any of them is added in large quantities as to exceed the concentration of 0.5%, hardening occurs on the welded portion as to degrade the stress corrosion crack resistance.

Group B: Nb: 0.1% or less, V: 0.5% or less, Ti: 0.2% or less, and B: 0.005% or less:

Any element of the group consisting of Nb, V, Ti, and B precipitates as a carbide, a nitride, or a carbonitride, and contributes to the production of fine crystal grains and to a higher strength. In particular, for steel pipes which have joints and which are heated to high temperatures, these elements function effectively in producing fine crystal grains during heating for joining, or as precipitation nuclei for ferrite during cooling. They are therefore effective in preventing hardening at joint portions. Thus, one or two or more elements can be added depending on the requirements. However, since their addition in large quantities leads to the degradation in weldability and toughness, the upper limits for the concentration of the elements are set as follows: 0.1% for Nb; 0.5%, preferably 0.3% for V; 0.2% for Ti; and 0.005%, preferably 0.004% for B. More preferably, the concentration range for the elements in Group B is from 0.005 to 0.05% for Nb, 0.05 to 0.1% for V, from 0.005 to 0.10% for Ti, and from 0.0005 to 0.002% for B.

To make the steel pipes useful for line pipes by improving the resistance against stress corrosion cracks, the concentration of Nb, V, and Ti is each restricted to be 0.1% or lower. If any of them should be added in large quantities as to exceed the concentration of 0.1%, hardening occurs on the welded portion as to degrade the stress corrosion crack resistance.

Group C: REM: 0.02% or less, and Ca: 0.01% or less:

REM and calcium Ca control the shape of inclusions and improve the workability. Any element of this group precipitates as a sulfide, an oxide, or a sulfate, and prevents hardening from occurring on the joint portions of steel pipes. Thus, one or more elements can be added depending on the requirements. However, if the addition should exceed the limits of 0.02% for REM and 0.01% for Ca, too many inclusions form as to lower clarity, and degradation in ductility occurs as a result. It should be noted that an addition of less than 0.004% for REM, or an addition of less than 0.001% of Ca exhibits small effect. Hence, it is preferred that REM are added as such to give a concentration of 0.004% or more, and that Ca is added to 0.001% or more.

The base steel pipes and product steel pipes contain, in addition to the components described above, balance Fe with unavoidable impurities. Allowable as the unavoidable impurities are 0.010% or less of N, 0.006% or less of 0, 0.025% or less of P, and 0.020% or less of S.

N: 0.010% or less:

Ni is allowed to a concentration of 0.010%; a quantity necessary to be combined with Al to produce fine crystal grains. However, an incorporation thereof in excess of this limit impairs the ductility. Hence, it is preferred that the concentration of N is lowered to 0.010% or lower, and more preferably, the concentration thereof is controlled to be in a range of from 0.002 to 0.006%.

O: 0.006% or less:

O impairs clarity by forming oxides. Their incorporation is not desirable, and its allowable limit is 0.006%.

P: 0.025% or less:

P is preferably not incorporated, because it impairs the toughness by segregation in grain boundaries. The allowable limit thereof is 0.025%.

S: 0.020% or less:

S is preferably not incorporated, because it increases sulfides and leads to the degradation of clarity. The allowable limit thereof is 0.020%.

Description on the structure of the product pipes is given below.

1) The steel pipe according to the present invention has excellent ductility and collision impact resistance properties, and comprises a texture based on ferrite grains having an average crystal diameter of 3 μm or less.

If the size of the ferrite grains exceeds 3 μm, no apparent improvement can be obtained in ductility as well as in collision impact resistance properties, i.e., the resistance properties against impact weight. Preferably, the average crystal size of ferrite grains is 1 μm or less.

The average crystal diameter of the ferrite grains in the present invention is obtained by observation under an optical microscope or an electron microscope. More specifically, a cross section obtained by cutting the steel pipe perpendicular to the longitudinal direction thereof, and the observation was made on the etched surface using Nital etchant. Thus, the diameter of the equivalent circle was obtained for 200 or more grains, and the average thereof was used as the representative value.

The structure based on ferrite grains as referred in the present invention includes a structure containing solely ferrite and having no precipitation of a second phase, and a structure containing ferrite and a second phase other than ferrite.

Mentioned as the second phase other than ferrite are martensite, bainite, and cementite, which may precipitate alone or as a composite of two or more thereof. The area ratio of the second phase should account for 30% or less. The second phase thus precipitated contributes to the increase in uniform elongation in case of deformation. Thus, it improves the ductility and the collision impact resistance properties. However, such an effect becomes less apparent if the area ratio of the second phase exceeds 30%.

2) The high strength steel pipe according to the present invention comprises a structure based on ferrite and a second phase accounting for more than 30% in area ratio, and contains grains having an average crystal diameter of 2 μm or less as observed on a cross section cut perpendicular to the longitudinal direction of the steel pipe. As the second phase other than ferrite, mentioned are martensite, bainite, and cementite, which may precipitate alone or as a composite of two or more thereof. The area ratio of the second phase should account for more than 30%. The second phase thus precipitated contributes to the increase in strength and in uniform elongation as to improve the strength and ductility. However, such an effect is small if the area ratio of the second phase is 30% or less. The area ratio of the second phase other than ferrite is therefore preferred to be more than 30% but not more than 60%. If the area ratio should exceed 60%, the ductility is impaired due to the coarsening of cementite grains.

If the average crystal diameter should exceed 2 μm, distinct improvement in ductility is no longer observed, and hence, there is no apparent improvement in the workability. Preferably, the average grain diameter of ferrite is 1 μm or less.

The average crystal grain diameter according to the present invention was obtained by observation under an optical microscope or an electron microscope. More specifically, a cross section obtained by cutting the steel pipe perpendicular to the longitudinal direction thereof, and the observation was made on the etched surface using Nital etchant. Thus, the diameter of the equivalent circle was obtained for 200 or more grains, and the average thereof was used as the representative value. The grain diameter of the second phase is obtained by taking the boundary of pearlite colony as the grain boundary in case pearlite is the second phase, and, by taking the packet boundary as the grain boundary in case bainite or martensite is the second phase.

Figure 3:
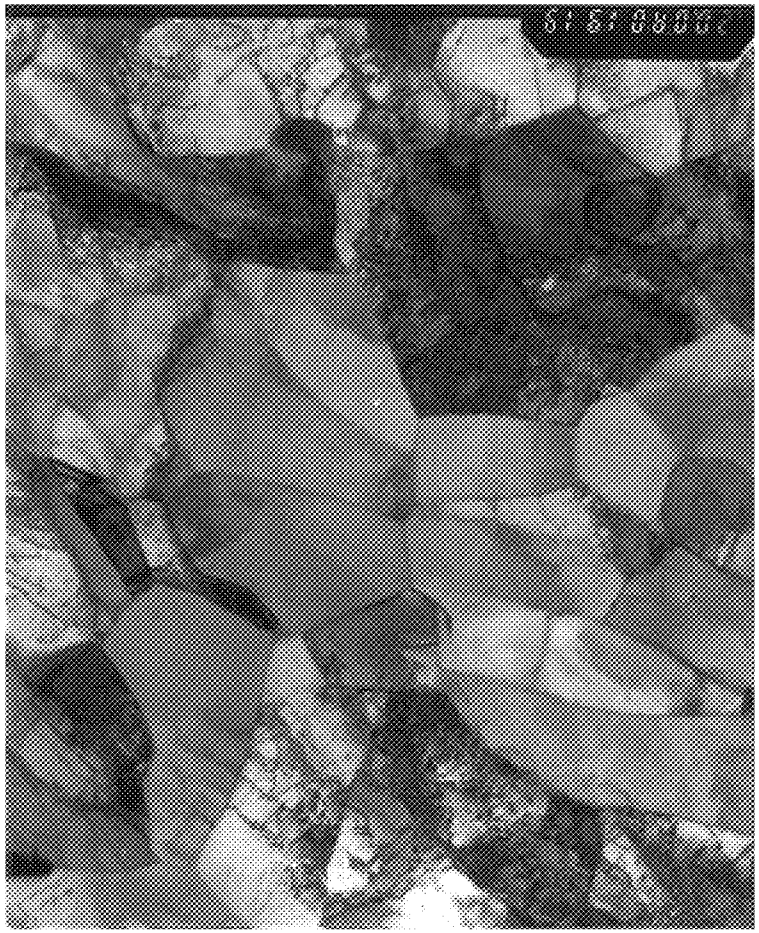
FIG. 3 is the electron micrograph showing the metallic texture of the steel pipe obtained as an example according to the present invention.

An example of the steel pipe according to the present invention is given in FIG. 3.

The method of producing the steel pipe according to the present invention is described below.

The base steel pipe of the composition described above is heated in a temperature range of $Ac_3$ to 400° C., preferably, to a range of ($Ac_1$+50° C.) to 400° C., and more preferably, to a range of 750 to 400° C.

If the heating temperature exceeds the $Ac_3$ transformation point, not only degradation of the surface properties, but also the coarsening of crystal grains occurs. Accordingly, the heating temperature for the base steel pipe is preferably set at a temperature not higher than the $Ac_3$ transformation point, preferably, not higher than the ($Ac_1$+50° C.), and more preferably, not higher than 750° C. On the other hand, if the heating temperature is lower than 400° C., a favorable rolling temperature cannot be realized. Thus, the heating temperature is preferably not lower than 400° C.

Then, the heated base steel pipe is subjected to drawing.

Although not limiting, drawing is preferably performed by using a three-roll type reducing mill. The reducing mill preferably comprises a plurality of stands, such that rolling is performed continuously. The number of stands can be determined depending on the size of the base steel pipe and the product steel pipe.

The rolling temperature for reducing is in a range corresponding to the ferrite recovery and recrystallization temperature range, i.e., from $Ac_3$ to 400° C., but preferably, in a range of ($Ac_1$+50° C.) to 400° C., and more preferably, in a range of from 750 to 400° C. If the rolling temperature should exceed the $Ac_3$ transformation point, no super fine crystal grains would become available, and ductility does not increase as expected in the expense of decreasing strength. Thus, the rolling temperature is set at a temperature not higher than $Ac_3$ transformation point, preferably, at a temperature not higher than ($Ac_1$+50° C.), and more preferably, not higher than 750° C. If the rolling temperature should be lower than 400° C., on the other hand, the material becomes brittle due to blue shortness (brittleness), and may undergo breakage.

Furthermore, at rolling temperatures lower than 400° C., not only the deformation resistance of the material increases as to make the rolling difficult, but also the working strain tends to remain due to insufficient recovery and recrystallization of the material. Thus, the drawing is performed in a limited temperature range of from $Ac_3$ to 400° C., preferably, in a range of ($Ac_1$+50° C.) to 400° C., and more preferably, in a range of from 750 to 400° C. Most preferably, the temperature range is from 600 to 700° C.

The cumulative reduction ratio in diameter during drawing is set at 20% or higher.

If the cumulative reduction ratio in diameter, which is equivalent to {[(outer diameter of the base steel pipe)−(outer diameter of the product pipe)]/(outer diameter of the base steel pipe)×100}, should be lower than 20%, the crystal grains subjected to recovery and recrystallization tend to be insufficiently reduced in size. Such a steel pipe cannot exhibit superior ductility. Furthermore, the production efficiency becomes low due to the low rate of pipe production. Accordingly, in the present invention, the cumulative reduction ratio in diameter is set at 20% or higher. However, at a cumulative reduction ratio of 60% or higher, not only an increase in strength due to work hardening occurs, but also fine structure becomes prominent. Thus, even in a steel pipe having a component system containing the alloy elements at a lower concentration than the aforementioned composition range, well balanced strength and ductility can be imparted thereto. It can be understood there from that, more preferably, the cumulative reduction ratio in diameter is set at 60% or higher.

In performing drawing, it is preferred that the rolling comprises at least one pass having a diameter reduction ratio per pass of 6% or higher.

If the diameter reduction ratio per pass during drawing should be set lower than 6%, fine crystal grains which result from recovery and recrystallization processes tend to be insufficiently reduced in size. On the other hand, with a diameter reduction ratio per pass of 6% or higher, an elevation in temperature occurs by the heat of working, which prevents the drop in temperature from occurring. Thus, the diameter reduction ratio per pass is preferably set at 8% or higher, so that high effect is obtained in realizing finer crystal grains.

The drawing process of the steel pipe according to the present invention realizes a rolling under biaxial strain, which is particularly effective in obtaining fine crystal grains. In contrast to this, the rolling of a steel sheet is under uniaxial strain because free end is present in the direction of sheet width (i.e., in the direction perpendicular to the rolling direction) Thus, the reduction in grain size becomes limited.

In the present invention, it is preferred that drawing is performed under lubricating conditions, By performing the drawing under lubrication, the strain distribution in the thickness direction becomes uniform that the distribution of crystal size distribution also becomes uniform in the thickness direction. If non-lubricating rolling should be performed, strain concentrates only on the surface layer portion of the material as to disturb the uniformity of the crystal grains in the thickness direction. The lubricating rolling can be carried out by using a rolling oil well known in the art, for instance, a mineral oil or a mineral oil mixed with a synthetic ester can be used without any limitations.

After reducing, the steel material is cooled to room temperature. Cooling can be performed by using air cooling, but from the viewpoint of suppressing the grain growth as much as possible, any of the cooling methods known in the art, for instance, water cooling, mist cooling, or forced air cooling, is applicable. The cooling rate is 1° C./sec or more, and preferably, 10° C./sec or more. Furthermore, stepwise cooling such as holding in the midway of cooling, can be employed depending on the requirements on the properties of the product.

In the method according to the present invention, drawing as described below can be applied to the base steel pipe by stably maintaining the crystal grain diameter of the product pipe to 1 μm or less, or to 2 μm or less in case of a high strength steel pipe.

Let the average crystal grain diameter of the ferrite grains, or, of that inclusive of the second phase in case of a high strength steel pipe, be di (μm), as observed in the cross section cut perpendicular to the longitudinal direction of the steel pipe at an outer diameter of ODi (mm). The base steel pipe is then heated or soaked, and is subjected to drawing at an average rolling temperature of θm (°C.) and at a total reduction ratio in diameter of Tred (%) as to obtain a finished product pipe having an outer diameter of ODf (mm).

Figure 4:
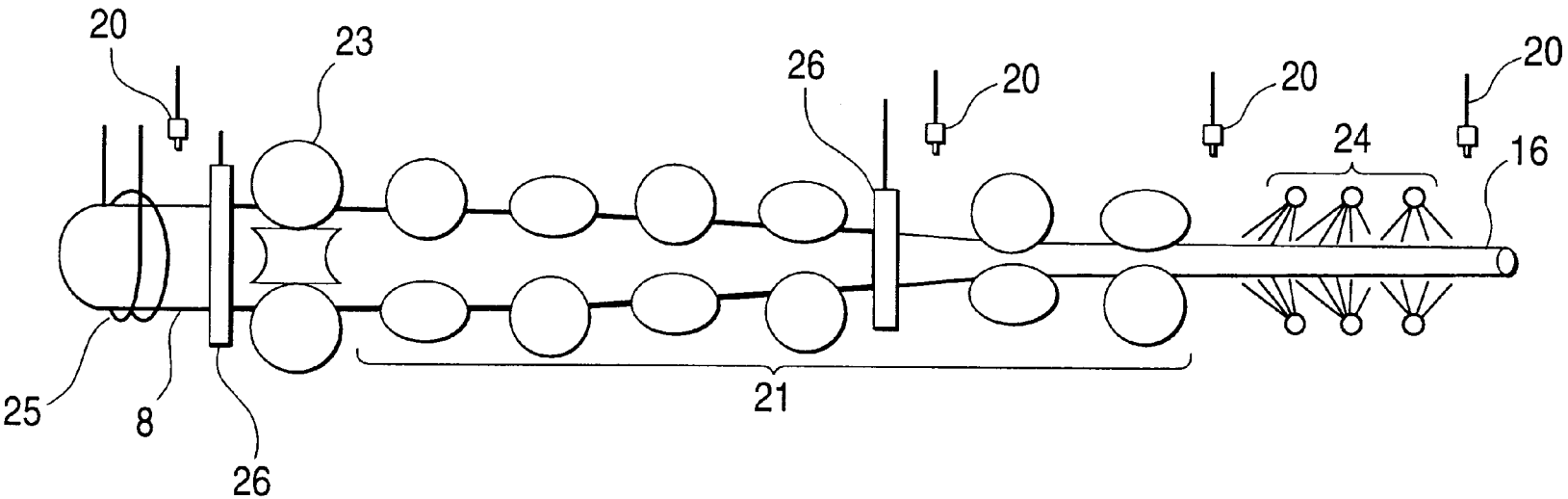
FIG. 4 is a schematically drawn diagram of an example of equipment line according to a preferred embodiment of the present invention.

The reducing is preferably applied by using a plurality of pass rollers called a reducer. An example of an equipment line suitable for carrying out the present invention is shown in FIG. 4. In FIG. 4 is shown a rolling apparatus 21 comprising a plurality of stands having a pass. The number of stands of the rolling mill is determined properly depending on the combination in the diameter of the base steel pipe and the product pipe. For the pass rolls, any type selected from the rolls well known in the art, for instance, two rolls, three rolls, or four rolls, can be favorably applied.

There is no particular limitation concerning the heating or soaking method, however, it is preferred that heating using a heating furnace or induction heating is employed. In particular, induction heating method is preferred from the viewpoint of high heating rate and of high productivity, or from the viewpoint of its ability of suppressing the growth of crystal grains. (In FIG. 4 is shown a re-heating apparatus 25 of an induction heating type.) The heating or soaking is performed at a temperature not higher than the $Ac_3$ transformation point corresponding to a temperature range at which no coarsening of crystal grain occurs, or, at a temperature not higher than ($Ac_1$+50° C.), by taking the $Ac_1$ transformation point of the base steel pipe as the standard, or more preferably, in the temperature range of from 600 to 700° C. In the present invention, as a matter of course, the product pipe results with fine crystal grains even if the heating or soaking of the base steel pipe should be performed at a temperature deviating from the temperature range above.

In case the second phase in the texture of the base steel pipe is pearlite, layered cementite incorporated in pearlite undergoes size reduction by separation by performing rolling in the temperature range above. Thus, the workability of the product pipe is improved because better elongation properties are acquired. Similarly, in case the second phase in the structure of the base steel pipe is bainite, the bainite undergoes recrystallization after working as to form a fine bainitic ferrite structure. Thus, the workability of the product pipe is improved because of the improved elongation properties.

The reducing is performed at a temperature range of 400° C. or more but not more than the heating or soaking temperature. Preferably, the temperature is not higher than 750° C. The temperature region over the $Ac_3$ transformation point, or over ($Ac_1$+50° C.), or over 750° C., corresponds to the ferrite-austenite two-phase region rich in austenite, or a single phase region of austenite. Thus, it is difficult to obtain a ferritic texture or a texture based on ferrite by working. Moreover, the effect of producing fine crystal grains by ferritic working cannot be fully exhibited. If drawing should be carried out at a temperature higher than 750° C., ferrite grains grow considerably after recrystallization as to make it difficult to obtain fine grains. In case drawing is performed at a temperature lower than 400° C., on the other hand, difficulties are found in carrying out the drawing because the temperature range corresponds to the blue brittleness region, or ductility and toughness decrease because working stress tends to remain due to insufficient recrystallization. Thus, drawing temperature is set at a temperature not lower than 400° C. but not higher than the $Ac_3$ transformation point, or at a temperature not higher than ($Ac_1$+50° C.), and preferably, at a temperature not higher than 750° C. More preferably, the temperature range is from 560 to 720° C., and most preferably, from 600 to 700° C.

The reducing is performed in the temperature range described above, and under the conditions satisfying equation (1), where di (μm) represents the average ferrite crystal diameter as observed in the cross section perpendicular to the longitudinal direction of the base steel pipe; θm (° C.)

represents the average rolling temperature in the drawing; and Tred (%) represents the total reduction ratio.

In case di, θm, and Tred do not satisfy the relation expressed by equation (1), the ferrite crystals of the resulting product pipe cannot be micro-grained as such to yield an average diameter (diameter as observed in the cross section perpendicular to the longitudinal direction of the steel pipe) of 1 μm or less. Similarly, the resulting high strength steel pipe cannot yield micro-grains as such having an average diameter (diameter as observed in the cross section perpendicular to the longitudinal direction of the steel pipe) of 2 μm or less.

Figure 6:
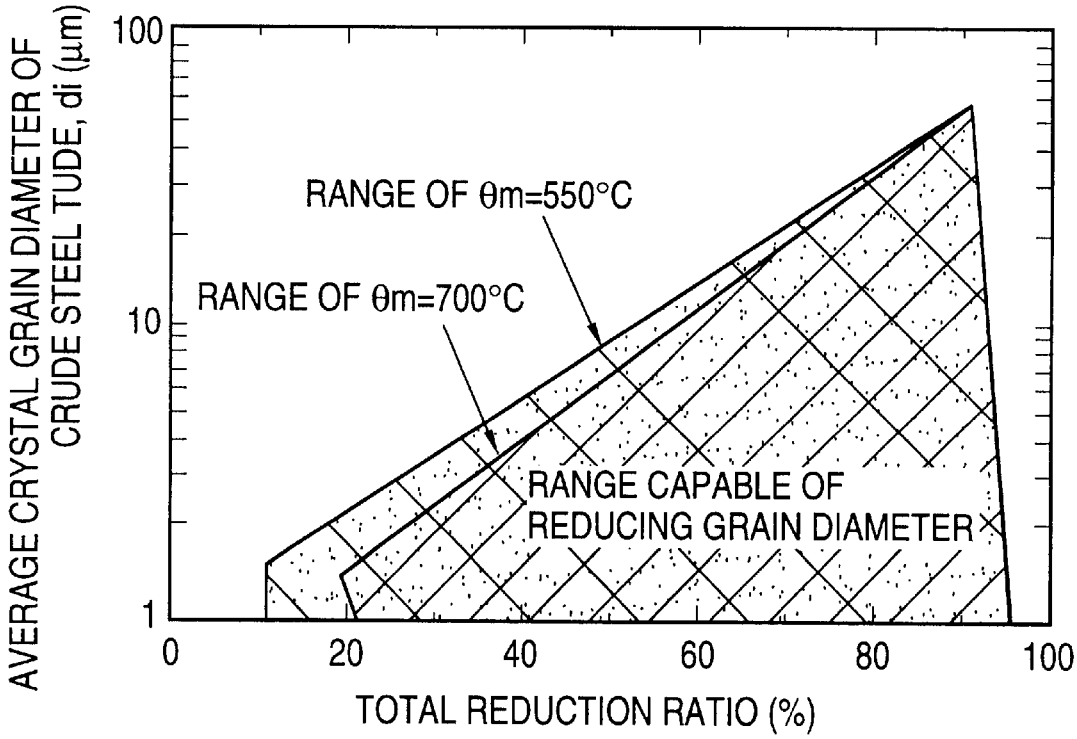
FIG. 6 is a graph showing the relation between the total reduction ratio and the average crystal grain size of the base steel pipe, which are the parameters that affect the size reduction of crystal grains of the product pipe.

Product steel pipes differing in diameter were produced by rolling a JIS STKM 13A equivalent base steel pipe (having an ODi of 60.3 mm and a wall thickness of 3.5 mm) by using a rolling apparatus consisting of serially connected 22 stands of 4-roll rolling mill, and under the conditions of an output speed is 200 m/min, an average rolling temperature of 550 or 700° C. The influence of the total reduction ratio in diameter and the average crystal diameter of the base steel pipe on the crystal grain diameter of the finished product pipe is shown in FIG. 6. The conditions shown by the hatched region satisfy the relation expressed by equation (1), and the base steel pipes with conditions falling in this region are capable of providing product pipes comprising crystal grains 1 μm or less in diameter.

After rolling, a product pipe 16 is preferably cooled to a temperature of 300° C. or lower. The cooling can be performed by air cooling, but with an aim to suppress the grain growth as much as possible, any of the cooling methods known in the art, for instance, water cooling, mist cooling, or forced air cooling, can be applied by using a quenching apparatus 24. The cooling rate is 1° C./sec or higher, and preferably, 10° C./sec or higher.

In the present invention, a cooling apparatus 26 may be installed on the input side of a rolling apparatus 21, or in the midway of the rolling apparatus 21 to control the temperature. Furthermore, a descaling apparatus 23 may be provided on the input side of the rolling apparatus 21.

Figure 5:
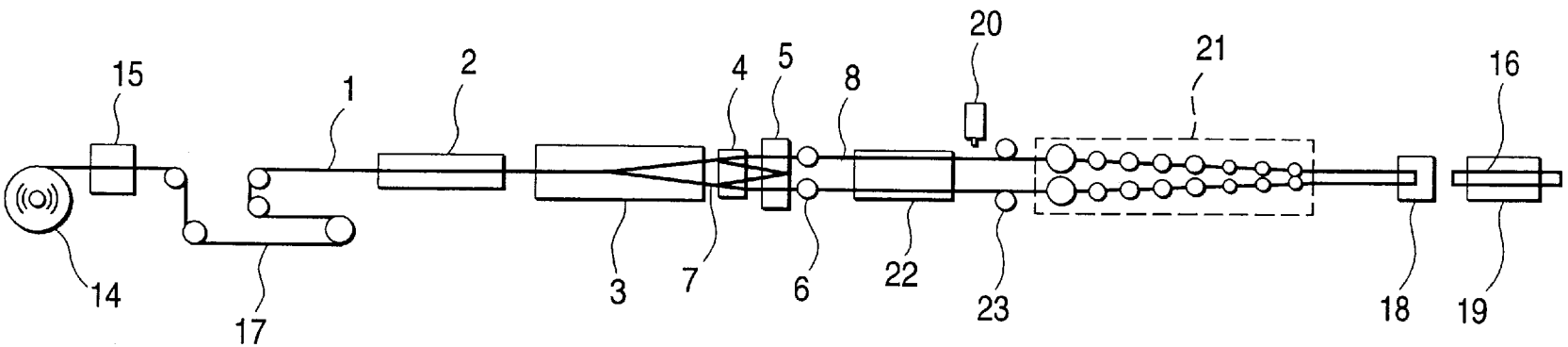
FIG. 5 is a schematically drawn diagram of an example of a production equipment for solid state pressure welded steel pipes and a production line for continuous production according to a preferred embodiment of the present invention.

The base steel pipe for use as the starting material in the present invention may be any steel pipe selected from a seamless steel pipe, a seam welded steel pipe, a forge welded steel pipe, a solid pressure welded steel pipe, and the like. Furthermore, the production line of the super fine granular steel pipe according to the present invention may be connected to the production line for the base steel pipe described hereinbefore. An example of connecting the production line to the production line of the solid pressure welded steel pipe is shown in FIG. 5.

A flat strip 1 output from an uncoiler 14 is connected to a preceding hoop by using a joining apparatus 15, and after being preheated by a pre-heating furnace 2 via a looper 17, it is worked into an open pipe 7 by using a forming apparatus 3 composed of a plurality of forming rolls. The edge portion of the open pipe 7 thus obtained is heated to a temperature region lower than the fusion point by an edge preheating induction heating apparatus 4 and an edge heating induction heating apparatus 5, and is butt welded by using a squeeze roll 6 to obtain a base steel pipe 8.

Then, as described above, the base steel pipe 8 is heated or soaked to a predetermined temperature by using a soaking furnace 22, descaled by a descaling apparatus 23, rolled by using a rolling apparatus 21, cut by a cutter, and straightened by a pipe straightening apparatus 19 to finally provide a product pipe 16. The temperature of the steel pipe is measured by using a thermometer 20.

Similarly in the case of drawing, as described above, rolling is preferably performed under lubrication.

Thus, in accordance with the production method described above, a steel pipe consisting of super-fine ferrite grains 1 μm or less in average crystal grain size as observed in the cross section cut perpendicular to the longitudinal direction of the steel material can be obtained. Furthermore, the production method above is effective in producing steel pipes, such as seam welded steel pipes, forge welded steel pipes, solid pressure welded steel pipes, etc., having a uniform hardness in the seam portion.

It is also possible to produce, without performing an intermediate annealing, a high strength steel pipe having a texture comprising ferrite and a second phase other than ferrite accounting for more than 30% in area ratio, and yet consisting of super-fine ferrite grains 2 μm or less in average crystal grain size as observed in the cross section cut perpendicular to the longitudinal direction of the steel material.

EXAMPLE 1

Base steel pipes whose chemical composition is shown in Table 1 were each heated to temperatures given in Table 2 by using an induction heating coil, and, by using three-roll structure rolling mills, they were rolled under conditions shown in Table 2 to provide product pipes. In Table 2, a solid state pressure welded steel pipe was obtained by pre-heating a 2.6 mm thick hot rolled flat strip to 600° C., continuously forming the resulting flat strip into an open pipe by using a plurality of rolls, pre-heating the both edge portions of the open pipe to, 1,000° C.by means of induction heating, and further heating the both edge portions to the non-melting temperature region of 1,450° C. by induction furnace, at which the both ends were butted by using a squeeze roll, where solid phase pressure welding was carried out. Thus was obtained a steel pipe 42.7 mm in diameter and 2.6 mm in thickness. On the other hand, a seamless steel pipe was produced by heating a continuously cast billet, followed by producing a pipe by using a Mannesmann mandrel type mill.

Tensile properties, collision impact properties, and structure of the product pipes were investigated, and the results are given in Table 2. Tensile properties were measured on a JIS No. 11 test piece. Yield stress was obtained by taking the lower yield point in case the yield phenomenon is clearly observed, but 0.2% PS was used for the other cases.

For the value of elongation, a reduced value was obtained in accordance with the following equation by taking the size effect of the test piece into consideration:

$$El=El0\times(\sqrt{(a0/a)})^{0.4}$$

(where, El0 represents the observed elongation, a0 is a value equivalent to 292 $mm^2$, and a represents the cross section area of the specimen ($mm^2$))

The collision impact properties were obtained by performing high speed tensile tests at a strain rate of 2,000 $s^{-1}$. Then, the absorbed energy up to a strain of 30% was obtained from the observed stress-strain curve to use as the collision impact absorption energy for evaluation.

The collision impact property is represented by a deformation energy of a material at a strain rate of from 1,000 to 2,000 $s^{-1}$ practically corresponding to the collision of an automobile, and is superior for a higher value.

From Table 2, it can be understood that the specimens falling in the scope of the present invention (Nos. 1 to 16 and Nos. 19 to 22) exhibit excellent balance in ductility and strength. Moreover, high tensile strength is observed for these specimens having higher strain rate, and these specimens are also high in collision impact absorption energy. On the other hand, the specimens falling out of the scope of claims according to the present invention, i.e., Comparative Examples No. 17, No. 18, and No. 23, suffer low values for either ductility or strength. These specimens suffer not only poor balance in strength-ductility, but also low collision impact property.

Comparative Example Nos. 17 and 18 furthermore yield a reduction ratio falling outside the range according to the present invention, show coarsening in ferrite grains, and suffer poor balance in strength-ductility and low collision impact absorption energy.

EXAMPLE 2

Base steel pipes whose chemical composition is shown in Table 3 were each heated to temperatures given in Table 4 by using an induction heating coil, and, by using three-roll structure rolling mills, they were rolled under conditions shown in Table 4 to provide product pipes. The base steel pipes were produced in the same procedure as that described in Example 1.

Tensile properties, collision impact properties, and structure of the product pipes were investigated in the same manner as in the Example, and the results are given in Table 4.

From Table 4, it can be understood that the specimens falling in the scope of the present invention (Nos. 2-1 to 2-3, Nos. 2-6 to 2-8, and Nos. 2-10 to Nos. 2-14) exhibit excellent balance in ductility and strength. Moreover, high tensile strength is observed for these specimens with higher strain rate, and these specimens are also high in collision impact absorption energy. on the other hand, the specimens falling out of the scope according to the present invention, i.e., Comparative Examples No. 2-4, No. 2-5, and No. 2-9, suffer low values for either ductility or strength. These specimens suffer not only poor balance in strength-ductility, but also low collision impact property.

The present invention provides steel pipes having not only a never achieved good balance in ductility and strength, but also excellent collision impact resistance properties. Furthermore, the steel pipes according to the present invention exhibit superior properties in secondary working, for instance, bulging such as hydroforming, and are therefore suitable for use in bulging.

Among the steel pipes according to the present invention, the welded steel pipes (seam welded steel pipes) and the solid phase pressure welded steel pipes subjected to seam cooling yield a hardened seam portion having a hardness at the same level as that of the mother pipe after rolling, and show further distinguished improvement in bulging.

EXAMPLE 3

Base steel pipes whose chemical composition is shown in Table 5 were each heated to temperatures given in Table 6 by using an induction heating coil, and, by using three-roll structure rolling mills, they were rolled under conditions shown in Table 6 to provide product pipes. The base steel pipes 110 mm in diameter and 4.5 mm in thickness were produced from hot rolled sheet steel produced by controlled rolling and controlled cooling.

Tensile properties, collision impact properties, the structure of the product pipes, and sulfide stress corrosion crack resistance were investigated, and the results are given in Table 6. Similar to Example 1, tensile properties were measured on a JIS No. 11 test piece. For the elongation, a reduced value was obtained in accordance with the following equation by taking the size effect of the test piece into consideration: $El=El0\times(\sqrt{}\times(a0/a))^{0.4}$ (where, El0 represents the observed elongation, a0 is a value equivalent to 292 $mm^2$, and a represents the cross section area of the specimen ($mm^2$)).

Similar to Example 1 again, the collision impact properties were obtained by performing high speed tensile tests at a strain rate of 2,000 $s^{-1}$. Then, the absorbed energy up to a strain of 30% was obtained from the observed stress-strain curve to use as the collision impact absorption energy for evaluation.

The collision impact property is represented by a deformation energy of a material at a strain rate of from 1,000 to 2,000 $s^{-1}$ practically corresponding to the collision of an automobile, and is superior for a higher value.

Figure 7:
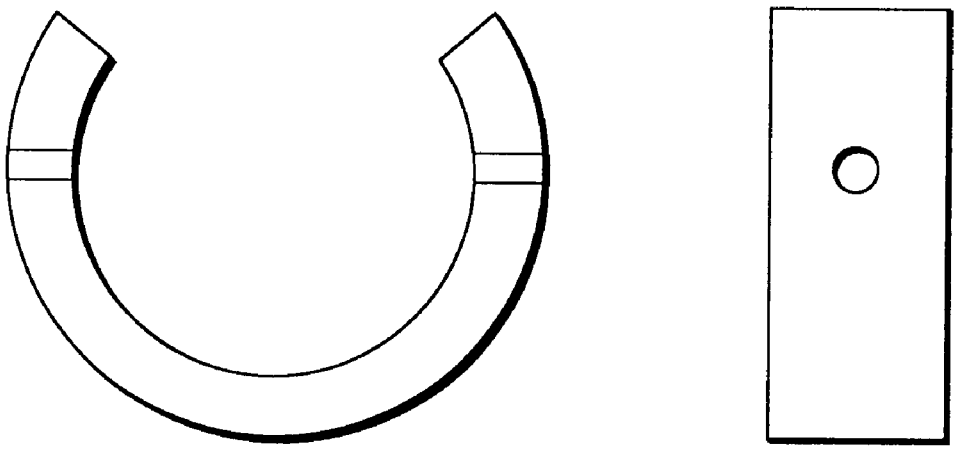
FIG. 7 is a schematically drawn explanatory diagram showing the shape of the test specimen for use in sulfide stress corrosion crack resistance test.

The sulfide stress corrosion crack resistance was evaluated on a C-ring test specimen shown in FIG. 7. Thus, a tensile stress corresponding to 120% of the yield strength was applied to the specimen in an NACE bath (containing 0.5% acetic acid and 5% brine water, saturated with $H_2S$, and at a temperature of 25° C. and a pressure of 1 atm) to investigate whether cracks generated or not during a test period of 200 hr. The C-ring specimens were cut out from the mother body of the product tube in the T direction (the circumferential direction). The test was performed on 2 pieces each under the same condition.

From Table 6, it can be understood that the specimens falling in the scope of the present invention (Nos. 3-1 to 3-3, Nos. 3-5 to 3-8, No. 3-10, and No. 3-12) exhibit excellent balance in ductility and strength. Moreover, high tensile strength is observed for these specimens having higher strain rate, and these specimens are also high in collision impact absorption energy. Furthermore, they have excellent resistance against sulfide stress corrosion cracks, and are therefore superior when used in line pipes. On the other hand, the specimens falling out of the scope according to the present invention, i.e., Comparative Examples No. 3-4, No. 3-9, and No. 3-11, suffer low values for either ductility or strength. These specimens suffer not only poor balance in strength-ductility, but also low collision impact property. Furthermore, breakage was found to occur on these specimens in the NACE bath, showing degradation in sulfide stress corrosion crack resistance.

Comparative Example No.3-4 yields a reduction ratio falling outside the range according to the present invention, shows coarsening in ferrite grains, suffers poor balance in strength-ductility and low collision impact absorption energy, and exhibits an impaired sulfide stress corrosion crack resistance.

Comparative Example No. 3-9 and No. 3-11 are produced at a rolling temperature falling out of the range according to the present invention. Hence, they show coarsening in ferrite grains, suffer poor balance in strength-ductility and low collision impact absorption energy, and exhibit impaired sulfide stress corrosion crack resistance.

EXAMPLE 4

Base steel pipes whose chemical composition is shown in Table 7 were each heated to temperatures given in Table 8 by using an induction heating coil, and, by using three-roll structure rolling mills, they were rolled under conditions shown in Table 8 to provide product pipes. The base steel pipes for use in the present example were produced by first forming a hot rolled hoop using a plurality of. forming rolls to obtain open pipes. Then, seam welded steel pipes 110 mm in diameter and 2.0 mm in thickness were produced by welding the both edges of each of the resulting open pipes using induction heating. Otherwise, seamless pipes 110 mm in diameter and 3.0 mm in thickness were produced by heating the continuously cast billets, and then producing pipes therefrom by using a Mannesmann mandrel type mill.

Tensile properties, collision impact properties, the structure, and the fatigue resistance properties of the product pipes were investigated, and the results are given in Table 8. Tensile properties, collision impact properties, and the structure were evaluated in the same manner as in Example 1.

For the fatigue properties, the product pipes were used as they are for the test specimens, to which cantilever type oscillation fatigue test was performed (oscillation speed: 20 Hz) Thus, fatigue strength was obtained.

From Table 8, it can be understood that the specimens falling in the scope the present invention (No. 4-1, No. 4-3, and Nos. 4-6 to 4-9) exhibit excellent balance in ductility and strength. Moreover, high tensile strength is observed for these specimens with higher strain rate, and these specimens are also high in collision impact absorption energy. Furthermore, they yield excellent fatigue resistance properties suitable for use as high fatigue strength steel pipes. On the other hand, the specimens falling out of the scope of claims according to the present invention, i.e., Comparative Examples No. 4-2, No. 4-4, and No. 4-5, suffer low values for fatigue strength.

Comparative Example No.4-2 is produced without applying the rolling according to the present invention, Comparative Example No. 4-5 of yields a reduction ratio falling out of the claimed range, and Comparative Example No. 4-4 is rolled at a temperature range out of the claimed range. Hence, they show coarsening in ferrite grains, suffer poor balance in strength-ductility and low collision impact absorption energy, and exhibit impaired fatigue resistance properties.

EXAMPLE 5

A starting steel material Al whose chemical composition is shown in Table 9 was hot rolled to provide a 4.5 mm thick flat strip. By using the production line shown in FIG. 5, the flat strip 1 was preheated to 600° C. in a preheating furnace 2, and was continuously formed into an open pipe by using a forming apparatus 3 composed of a plurality of groups of forming rolls. The edge portions of each of the open pipes 7 thus obtained were heated to 1,000° C. by an edge preheating induction heating apparatus 4, and were then heated to 1,450° C. by using an edge heating induction heating apparatus 5, where they were butted and solid phase pressure welded by using squeeze rolls 6 to obtain base steel pipes 8 having a diameter of 88.0 mm and a thickness of 4.5 mm.

Then, each of the base steel pipes was subjected to seam cooling, and was heated or soaked to a predetermined temperature shown in Table 10 by using a pipe heating apparatus 22, and a product pipe having the predetermined outer diameter was produced therefrom by using a rolling apparatus 21 composed of a plurality of three-roll structured rolling mill. The number of stands was varied depending on the outer diameter of the product pipe; i.e., 6 stands were used for a product pipe having an outer diameter of 60.3 mm, whereas 16 stands were used for those having an outer diameter of 42.7 mm.

In the rolling step above, the product pipe of No. 5-2 was subjected to lubrication rolling by using a rolling oil based on mineral oil mixed with a synthetic ester.

The product pipes were air cooled after rolling.

Crystal grain diameter, tensile properties, and impact resistance properties were investigated for each of the product pipes thus obtained, and the results are given in Table 10. The crystal grain diameter was obtained by microscopic observation under a magnification of 5,000 times of at least 5 vision fields taken on a cross section (C cross section) perpendicular to the longitudinal direction of the steel pipe, thus measuring the average crystal grain diameter of ferrite grains. Tensile properties were measured on a JIS No. 11 test piece. For the elongation, a reduced value was obtained in accordance with the following equation by taking the size effect of the test piece into consideration: $El=El0\times(\sqrt{\times}(a0/a))^{0.4}$ (where, El0 represents the observed elongation, a0 is a value equivalent to 100 $mm^2$, and a represents the cross section area of the specimen ($mm^2$)). Impact properties (toughness) were evaluated by subjecting the actual pipe to Charpy impact tests, and by using the ductile rupture ratio in C cross section at a temperature of −150° C. Charpy impact test on an actual pipe was performed by applying impact to an actual pipe V-notched for 2 mm in a direction perpendicular to the longitudinal direction of the pipe, and the ratio of ductile rupture was obtained therefrom.

From Table 10, it can be understood that the specimens falling in the scope of the present invention (No. 5-2, Nos. 5-4 to 5-7, Nos. 5-9 to 5-11, and No. 5-13) consist of fine ferrite grains 1 $\mu$m or less in average crystal diameter, have high elongation and toughness, and exhibit excellent balance in strength, toughness, and ductility. In case of specimen No. 5-2 subjected to lubrication rolling, small fluctuation was observed in crystal grains along the direction of pipe thickness. On the other hand, the specimens falling out of the scope according to the present invention, i.e., the Comparative Examples (No. 5-1, No. 5-3, No. 5-8, and No. 5-12), exhibit coarsened crystal grains and suffer degradation in ductility and toughness. It has been found that the texture of the product pipes falling in the scope of claims of the present invention consists of ferrite and pearlite grains, ferrite and cementite grains, or ferrite and bainite grains.

EXAMPLE 6

A steel material B1 whose chemical composition is shown in Table 9 was molten in a converter, and billets were formed therefrom by continuous casting. The resulting billets were heated, and seamless pipes 110.0 mm in diameter and 6.0 mm in thickness were obtained therefrom by using a Mannesmann mandrel type mill. The seamless pipes thus obtained were re-heated to temperatures shown in Table 11 by using induction heating coils, and product pipes having the outer diameter shown in Table 11 were produced therefrom by using a three-roll structured rolling mill. The number of stands was varied depending on the outer diameter of the product pipe; i.e., 18 stands were used for a product pipe having an outer diameter of 60.3 mm, 20 stands were used for a product pipe 42.7 mm in diameter, 24 stands were used for a product pipe 31.8 mm in diameter, and 28 stands were used for those having an outer diameter of 25.4 mm.

The characteristic properties of the product pipes were each investigated and are shown in Table 11. Thus, investigations were made in the same manner as in Example 5 on the structure, crystal grain size, tensile properties, and toughness.

From Table 11, it can be understood that the specimens falling in the scope of the present invention (No. 6-1, No. 6-3, No. 6-6, No. 6-7, and No. 6-9) consist of fine ferrite grains 1 μm or less in average crystal diameter, have high elongation and toughness, and exhibit excellent balance in strength, toughness, and ductility. On the other hand, the specimens falling out of the scope according to the present invention, i.e., the Comparative Examples (No. 6-2, No. 6-4, No. 6-5, and No. 6-8), exhibit coarsened crystal grains and suffer degradation in ductility and toughness.

It has been found that the texture of the product pipes falling in the scope of claims of the present invention consists of ferrite and pearlite grains, ferrite and cementite grains, or ferrite and bainite grains.

EXAMPLE 7

Starting steel materials whose chemical composition is shown in Table 12 were each heated to temperatures given in Table 13 by using an induction heating coil, and, by using three-roll structure rolling mills, they were rolled under conditions shown in Table 13 to provide product pipes. The number of stands was varied depending on the type of the pipe; i.e., 24 stands were used for seamless pipes, whereas 16 stands were used for solid phase pressure welded pipes and seam welded pipes.

In Table 13, a solid state pressure welded steel pipe was obtained by pre-heating a 2.3 mm thick hot rolled flat strip to 600° C., continuously forming the resulting flat strip into an open pipe by using a plurality of rolls, pre-heating the both edge portions of the open pipe to 1,000° C. by means of induction heating, further heating the both edge portions by induction furnace to a temperature of 1,450° C., i.e., to a temperature below the melting, at which the both ends were butted by using a squeeze roll, and carrying out solid phase pressure welding. Thus was obtained the steel pipes having the predetermined outer diameter. On the other hand, seamless steel pipes were produced by heating a continuously cast billet, and producing therefrom the seamless pipes 110.0 mm in diameter and 4.5 mm in thickness by using a Mannesmann mandrel type mill.

The characteristic properties of the product pipes were each investigated and are shown in Table 13. Thus, investigations were made in the same manner as in Example 1 on the structure, crystal grain size, tensile properties, and toughness.

From Table 13, it can be understood that the specimens falling in the scope of the present invention consist of fine ferrite grains 1 μm or less in average crystal diameter, have high elongation and toughness, and exhibit excellent balance in strength, toughness, and ductility. It has been found that the structure of the product pipes falling in the scope of claims of the present invention consists of ferrite and pearlite grains, or of ferrite, pearlite, and bainite grains, or of ferrite and cementite grains, or of ferrite and martensite grains.

EXAMPLE 8

Each of the starting steel materials whose chemical composition is shown in Table 14 was hot rolled to provide a 4.5 mm thick flat strip. By using the production line shown in FIG. 5, the flat strip 1 was preheated to 600° C. in a preheating furnace 2, and was continuously formed into an open pipe by using a forming apparatus 3 composed of a plurality of groups of forming rolls. The edge portions of each of the open pipes 7 thus obtained were heated to 1,000° C. by an edge preheating induction heating apparatus 4, and were then heated to 1,450° C. by using an edge heating induction heating apparatus 5, where they were butted and solid phase pressure welded by using squeeze rolls 6 to obtain base steel pipes 8 having a diameter of 110.0 mm and a thickness of 4.5 mm.

Then, each of the base steel pipes was subjected to seam cooling, and was heated or soaked to a predetermined temperature shown in Table 15 by using a pipe heating apparatus 22, and a product pipe having the predetermined outer diameter was produced therefrom by using a rolling apparatus 21 composed of a plurality of three-roll structured rolling mill. The number of stands was varied depending on the outer diameter of the product pipe; i.e., 6 stands were used for a product pipe having an outer diameter of 60.3 mm, whereas 16 stands were used for those having an outer diameter of 42.7 mm.

In the rolling step above, the product pipe of No. 1-2 was subjected to lubrication rolling by using a rolling oil based on mineral oil mixed with a synthetic ester.

The product pipes were air cooled after rolling.

Crystal grain diameter and tensile properties were investigated for each of the product pipes thus obtained, and the results are given in Table 15. The crystal grain diameter was obtained by microscopic observation under a magnification of 5,000 times of at least 5 vision fields taken on a cross section (C cross section) perpendicular to the longitudinal direction of the steel pipe, thus measuring the average crystal grain diameter of ferrite grains. Tensile properties were measured on a JIS No. 11 test piece. For the elongation, a reduced value was obtained in accordance with the following equation by taking the size effect of the test piece into consideration: $El=El0\times(\sqrt{(a0/a)})^{0.4}$ (where, El0 represents the observed elongation, a0 is a value equivalent to 100 $mm^2$, and a represents the cross section area of the specimen ($mm^2$))

From Table 15, it can be understood that the specimens falling in the scope of the present invention (No. 1-2, Nos. 1-4 to 1-7, and No.1-10) consist of fine grains 2 μm or less in average crystal diameter, have high elongation and toughness, yield a tensile strength of 600 MPa or higher, and exhibit excellent balance in strength, toughness, and ductility.

In case of specimen No.1-2 subjected to lubrication rolling, small fluctuation was observed in crystal grains along the direction of pipe thickness. On the other hand, the specimens falling out of the scope according to the present invention, i.e., the Comparative examples (No. 1-1, No. 1-3, No. 1-8, and No. 1-9), exhibit coarsened crystal grains and suffer degradation in ductility.

It has been found that the texture of the product pipes falling in the scope of claims of the present invention comprises ferrite, and cementite which accounts for more than 30% in area ratio as a second phase.

EXAMPLE 9

Each of the base steel pipes whose chemical composition is shown in Table 16 was re-heated by an induction heating coil to temperatures shown in Table 17, and product pipes each having the outer diameter shown in Table 17 were each obtained therefrom by using a three-roll structure rolling mill apparatus. The number of stands used in the rolling mill was 16.

The characteristic properties of the product pipes were each investigated and are shown in Table 17. Thus, investigations were made in the same manner as in Example 8 on the texture, crystal grain size, and tensile properties.

From Table 17, it can be understood that the specimens (Nos. 2-1 to 2-6) falling in the scope of the present invention consist of fine ferrite grains 2 μm or less in average crystal diameter, yield a tensile strength of 600 MPa or higher, have high elongation, and exhibit excellent balance in strength and ductility. On the other hand, the specimens falling out of the scope according to the present invention, i.e., the Comparative Examples (No. 2-7 and No. 2-8), exhibit coarsened crystal grains and suffer degradation in strength that a targeted tensile strength is not obtained.

It has been found that the texture of the product pipes falling in the scope of the present invention comprises ferrite, and a second phase containing pearlite, cementite, bainite, or martensite, which accounts for more than 30% in area ratio.

As described above, the present invention provides high strength steel pipes considerably improved in balance of ductility and strength. Moreover, the steel pipes according to the present invention exhibit superior properties in secondary working, for instance, bulging such as hydroforming. Hence, they are particularly suitable for use in bulging.

Among the steel pipes according to the present invention, the welded steel pipes and the solid state pressure welded steel pipes subjected to seam cooling yield a hardened seam portion having a hardness at the same level as that of the mother pipe after rolling, and show further distinguished improvement in bulging.

TABLE 1

| Steel | Chemical Composition (wt %) | | | | | | | | $Ac_1$ | $Ac_3$ | |
|---|---|---|---|---|---|---|---|---|---|---|---|
| No. | C | Si | Mn | P | S | Al | N | O | ° C. | ° C. | Note |
| A | 0.09 | 0.40 | 0.80 | 0.012 | 0.005 | 0.035 | 0.0035 | 0.0025 | 770 | 900 | Invention |
| B | 0.08 | 0.07 | 1.42 | 0.015 | 0.011 | 0.036 | 0.0038 | 0.0036 | 760 | 875 | Invention |
| C | 0.06 | 0.21 | 0.35 | 0.013 | 0.008 | 0.028 | 0.0025 | 0.0028 | 775 | 905 | Invention |
| D | 0.11 | 0.22 | 0.45 | 0.017 | 0.013 | 0.018 | 0.0071 | 0.0035 | 775 | 885 | Invention |
| E | 0.21 | 0.20 | 0.50 | 0.016 | 0.013 | 0.024 | 0.0043 | 0.0030 | 770 | 855 | Invention |
| F | 0.03 | 0.05 | 0.15 | 0.021 | 0.007 | 0.041 | 0.0026 | 0.0038 | 780 | 905 | Invention |
| G | 0.09 | 0.15 | 0.52 | 0.024 | 0.003 | 0.004 | 0.0025 | 0.0026 | 775 | 890 | Invention |

TABLE 2-1

| | | Base steel pipe | | Conditions of reduction rolling | | | | | | | |
|---|---|---|---|---|---|---|---|---|---|---|---|
| No. | Steel No. | Type | Outer diameter mm | Heating temp. ° C. | Temp. of starting rolling ° C. | Temp. of finishing rolling ° C. | Cumulative reduction ratio % | Total No. of pass | No. of pass 6% or more | Final rolling speed m/min | Outer diameter of pipe product mm |
| 1 | A | Solid phase pressure welded pipe | 42.7 | 750 | 710 | 690 | 65 | 14 | 9 | 200 | 15.0 |
| 2 | A | Solid phase pressure welded pipe | 42.7 | 700 | 670 | 660 | 65 | 14 | 9 | 200 | 15.0 |
| 3 | A | Solid phase pressure welded pipe | 42.7 | 650 | 635 | 620 | 65 | 14 | 9 | 200 | 15.0 |
| 4 | A | Solid phase pressure welded pipe | 42.7 | 700 | 655 | 630 | 40 | 7 | 4 | 140 | 25.5 |
| 5 | A | Solid phase pressure welded pipe | 42.7 | 650 | 605 | 590 | 40 | 7 | 4 | 140 | 25.5 |
| 6 | A | Solid phase pressure welded pipe | 42.7 | 700 | 660 | 630 | 30 | 5 | 3 | 120 | 29.7 |
| 7 | A | Solid phase pressure welded pipe | 42.7 | 650 | 6i5 | 590 | 30 | 5 | 3 | 120 | 29.7 |
| 8 | A | Solid phase pressure welded pipe | 42.7 | 700 | 660 | 640 | 22 | 3 | 2 | 110 | 33.2 |
| 9 | A | Solid phase pressure welded pipe | 42.7 | 650 | 615 | 585 | 22 | 3 | 2 | 110 | 33.2 |
| 10 | A | Solid phase pressure welded pipe | 42.7 | 650 | 620 | 580 | 22 | 7 | 0 | 110 | 33.2 |

| | | Characteristics of pipe product | | | | | | | | |
|---|---|---|---|---|---|---|---|---|---|---|
| No. | Steel No. | Tensile strength TS MPa | Elongation El % | High speed tensile strength MPa | Collision impact absorped energy $MJ \cdot m^{-3}$ | Ferrite grain diameter μm | Area ratio of second phase % | Type of second phase* | Miscell-aneous | Note |
| 1 | A | 525 | 44 | 728 | 242 | 2.0 | 10 | C | | Invention |
| 2 | A | 575 | 43 | 780 | 260 | 2.0 | 11 | C | | Invention |
| 3 | A | 622 | 40 | 864 | 292 | 1.0 | 11 | C | | Invention |
| 4 | A | 537 | 43 | 761 | 257 | 1.0 | 11 | C | | Invention |
| 5 | A | 580 | 38 | 799 | 267 | 1.5 | 11 | C | | Invention |
| 6 | A | 512 | 40 | 724 | 241 | 1.5 | 11 | C | | Invention |
| 7 | A | 562 | 38 | 799 | 268 | 1.0 | 11 | C | | Invention |

TABLE 2-1-continued

| | | | | | | | | | |
|---|---|---|---|---|---|---|---|---|---|
| 8 | A | 493 | 42 | 712 | 230 | 1.0 | 11 | C | Invention |
| 9 | A | 541 | 39 | 755 | 249 | 1.5 | 11 | C | Invention |
| 10 | A | 537 | 36 | 751 | 242 | 1.5 | 11 | C | Invention |

TABLE 2-2

| | | Base steel pipe | | Conditions of reduction rolling | | | | | | | |
|---|---|---|---|---|---|---|---|---|---|---|---|
| No. | Steel No. | Type | Outer diameter mm | Heating temp. ° C. | Temp. of starting rolling ° C. | Temp. of finishing rolling ° C. | Cumulative reduction ratio % | Total No. of pass | No. of pass 6% or more | Final rolling speed m/min | Outer diameter of pipe product mm |
| 11 | B | Seam welded steel pipe | 42.7 | 650 | 650 | 622 | 65 | 14 | 9 | 200 | 15.0 |
| 12 | B | Seam welded steel pipe | 42.7 | 600 | 590 | 580 | 65 | 14 | 9 | 200 | 15.0 |
| 13 | C | Seam welded steel pipe | 42.7 | 650 | 640 | 620 | 65 | 14 | 9 | 200 | 15.0 |
| 14 | D | Seamless steel pipe | 110 | 700 | 695 | 670 | 77 | 17 | 10 | 150 | 25.6 |
| 15 | E | Seamless steel pipe | 110 | 700 | 695 | 670 | 77 | 17 | 10 | 150 | 25.6 |
| 16 | A | Solid phase pressure welded pipe | 42.7 | 550 | 540 | 528 | 85 | 14 | 9 | 200 | 15.0 |
| 17 | C | Seam welded steel pipe | 42.7 | — | — | — | 0 | — | — | — | 42.7 |
| 18 | C | Seam welded steel pipe | 42.7 | 650 | 630 | 615 | 11 | 3 | 1 | 80 | 38.0 |
| 19 | F | Seam welded steel pipe | 42.7 | 650 | 600 | 545 | 65 | 14 | 9 | 200 | 15.0 |
| 20 | G | Seam welded steel pipe | 42.7 | 750 | 705 | 690 | 65 | 14 | 9 | 200 | 15.0 |
| 21 | G | Seam welded steel pipe | 42.7 | 650 | 620 | 615 | 65 | 14 | 9 | 200 | 15.0 |
| 22 | G | Seam welded steel pipe | 42.7 | 750 | 710 | 685 | 41 | 7 | 4 | 140 | 25.3 |
| 23 | G | Seam welded steel pipe | 42.7 | 950 | 910 | 890 | 22 | 3 | 2 | 110 | 33.1 |

| | | Characteristics of pipe product | | | | | | | | |
|---|---|---|---|---|---|---|---|---|---|---|
| No. | Steel No. | Tensile strength TS MPa | Elongation El % | High speed tensile strength MPa | Collision impact absorped energy $MJ \cdot m^{-1}$ | Ferrite grain diameter $\mu m$ | Area ratio of second phase % | Type of second phase* | Miscell-aneous | Note |
| 11 | B | 555 | 42 | 792 | 265 | 1.0 | 15 | C | | Invention |
| 12 | B | 611 | 37 | 850 | 289 | 1.0 | 15 | C | | Invention |
| 13 | C | 492 | 42 | 685 | 225 | 2.5 | 7 | C | | Invention |
| 14 | D | 415 | 52 | 666 | 219 | 2.0 | 9 | C | | Invention |
| 15 | E | 526 | 46 | 733 | 231 | 2.0 | 22 | C + B | | Invention |
| 16 | A | 688 | 30 | 892 | 299 | 2.5 | 12 | C | | Invention |
| 17 | C | 409 | 43 | 566 | 185 | 11.0 | 6 | P | ** | Comparative |
| 18 | C | 427 | 40 | 570 | 191 | 7.0 | 8 | C | | Invention |
| 19 | F | 552 | 29 | 744 | 248 | 3.0 | 0 | — | | Invention |
| 20 | G | 431 | 48 | 611 | 202 | 3.0 | 13 | C | | Invention |
| 21 | G | 511 | 33 | 704 | 233 | 3.0 | 13 | C | | Invention |
| 22 | G | 425 | 47 | 604 | 206 | 3.0 | 12 | C | | Invention |
| 23 | G | 410 | 45 | 570 | 183 | 18.0 | 13 | C | | Comparative |

Note)
*C: Cementite, B: Bainite, M: Martensite, P: Pearlite
**Without reduction rolling

TABLE 3

| Steel | Chemical composition (wt. %) | | | | | | | | | | | | |
|---|---|---|---|---|---|---|---|---|---|---|---|---|---|
| No. | C | Si | Mn | P | S | Al | N | O | Cu | Ni | Cr | Mo | V |
| H | 0.07 | 0.20 | 0.66 | 0.018 | 0.005 | 0.028 | 0.0022 | 0.0025 | — | — | — | — | — |
| I | 0.08 | 0.04 | 1.35 | 0.015 | 0.011 | 0.036 | 0.0041 | 0.0032 | — | — | — | — | 0.10 |
| J | 0.15 | 0.21 | 0.55 | 0.009 | 0.004 | 0.010 | 0.0028 | 0.0028 | — | — | 0.21 | 0.53 | — |
| K | 0.05 | 1.01 | 1.35 | 0.012 | 0.001 | 0.035 | 0.0030 | 0.0030 | — | — | 0.92 | — | — |
| L | 0.15 | 0.22 | 0.41 | 0.018 | 0.003 | 0.031 | 0.0036 | 0.0038 | 0.11 | 0.15 | — | — | — |

TABLE 3-continued

| Steel No. | Chemical composition (wt. %) Nb | Ti | B | Ca | $Ac_1$ ° C. | $Ac_3$ ° C. | Note |
|---|---|---|---|---|---|---|---|
| H | 0.009 | 0.008 | — | — | 765 | 895 | Invention |
| I | — | — | — | 0.002 | 755 | 885 | Invention |
| J | — | — | — | — | 785 | 80 | Invention |
| K | 0.015 | 0.011 | 0.0023 | — | 790 | 905 | Invention |
| L | — | — | — | 0.002 | 760 | 875 | Invention |

TABLE 4

| | | Base steel pipe | | Conditions of reduction rolling | | | | | | | |
|---|---|---|---|---|---|---|---|---|---|---|---|
| No. | Steel No. | Type | Outer diameter mm | Heating temp. ° C. | Temp. of starting rolling ° C. | Temp. of finishing rolling ° C. | Cumulative reduction ratio % | Total No. of pass | No. of pass 6% or more | Final rolling speed m/min | Outer diameter of pipe product mm |
| 2-1 | H | Solid phase pressure welded pipe | 42.7 | 730 | 700 | 640 | 65 | 14 | 9 | 200 | 15.0 |
| 2-2 | | Solid phase pressure welded pipe | 42.7 | 670 | 640 | 600 | 65 | 14 | 9 | 200 | 15.0 |
| 2-3 | | Solid phase pressure welded pipe | 42.7 | 620 | 600 | 560 | 65 | 14 | 9 | 200 | 15.0 |
| 2-4 | | Solid phase pressure welded pipe | 42.7 | — | — | — | 0 | — | — | — | 42.7 |
| 2-5 | | Solid phase pressure welded pipe | 42.7 | 670 | 640 | 600 | 11 | 3 | 1 | 80 | 38.0 |
| 2-6 | I | Solid phase pressure welded pipe | 42.7 | 700 | 670 | 620 | 41 | 7 | 4 | 140 | 25.3 |
| 2-7 | | Solid phase pressure welded pipe | 42.7 | 800 | 780 | 770 | 41 | 7 | 4 | 140 | 25.3 |
| 2-8 | | Solid phase pressure welded pipe | 42.7 | 850 | 830 | 820 | 41 | 7 | 4 | 140 | 25.3 |
| 2-9 | | Solid phase pressure welded pipe | 42.7 | 950 | 930 | 910 | 41 | 7 | 4 | 140 | 25.3 |
| 2-10 | J | Seamless steel pipe | 110 | 700 | 700 | 690 | 69 | 17 | 15 | 400 | 34.1 |
| 2-11 | K | Seam welded steel pipe | 42.7 | 720 | 690 | 650 | 65 | 14 | 9 | 200 | 15.0 |
| 2-12 | L | Seamless steel pipe | 110 | 700 | 700 | 680 | 77 | 24 | 18 | 400 | 25.4 |
| 2-13 | | Seamless steel pipe | 110 | 800 | 780 | 770 | 77 | 24 | 18 | 400 | 25.4 |
| 2-14 | | Seamless steel pipe | 110 | 850 | 830 | 820 | 77 | 24 | 18 | 400 | 25.4 |

| | | Characteristics of pipe product | | | | | | | | |
|---|---|---|---|---|---|---|---|---|---|---|
| No. | Steel No. | Tensile strength TS MPa | Elongation El % | High speed tensile strength MPa | Collision impact absorped energy $MJ \cdot m^{-3}$ | Ferrite grain diameter $\mu m$ | Area ratio of second phase % | Type of second phase* | Miscell-aneous | Note |
| 2-1 | H | 530 | 43 | 734 | 242 | 2.0 | 8 | C | | Invention |
| 2-2 | | 640 | 38 | 884 | 301 | 1.0 | 7 | C | | Invention |
| 2-3 | | 730 | 32 | 931 | 318 | 2.0 | 8 | C | | Invention |
| 2-4 | | 470 | 40 | 640 | 196 | 7.0 | 7 | C | ** | Comparatlve |
| 2-5 | | 490 | 37 | 666 | 199 | 6.0 | 8 | C | | Comparative |
| 2-6 | I | 530 | 40 | 724 | 240 | 2.5 | 13 | C | | Invention |
| 2-7 | | 500 | 44 | 682 | 223 | 2.5 | 12 | C | | Invention |
| 2-8 | | 480 | 41 | 644 | 205 | 2.8 | 14 | C + P | | Invention |
| 2-9 | | 390 | 40 | 532 | 130 | 6.5 | 15 | P | | Comparative |
| 2-10 | J | 663 | 42 | 885 | 298 | 1.5 | 23 | C + B | | Invention |
| 2-11 | K | 712 | 34 | 931 | 318 | 1.5 | 12 | M | | Invention |
| 2-12 | L | 581 | 44 | 802 | 259 | 1.5 | 18 | C | | Invention |
| 2-13 | | 556 | 46 | 757 | 236 | 2.0 | 20 | C | | Invention |
| 2-14 | | 500 | 40 | 658 | 210 | 2.5 | 21 | C + P | | Invention |

Note)
*C: Cementite, B: Bainite, M: Martensite, P: Pearlite
**Without reduction rolling

TABLE 5

| Steel | Chemical composition (wt. %) | | | | | | | | | | | | |
|---|---|---|---|---|---|---|---|---|---|---|---|---|---|
| No. | C | Si | Mn | P | S | Al | N | O | Cu | Ni | Cr | Mo | V |
| M | 0.05 | 0.30 | 1.22 | 0.007 | 0.001 | 0.022 | 0.0030 | 0.0028 | — | 0.20 | — | 0.05 | 0.05 |
| N | 0.08 | 0.51 | 1.41 | 0.008 | 0.001 | 0.028 | 0.0035 | 0.0019 | 0.12 | 0.18 | 0.15 | — | 0.02 |
| O | 0.06 | 0.28 | 6.95 | 0.009 | 0.001 | 0.025 | 0.0026 | 0.0025 | — | 0.15 | — | 0.06 | 0.02 |
| P | 0.06 | 0.30 | 1.18 | 0.008 | 0.001 | 0.028 | 0.0031 | 0.0023 | 0.15 | 0.15 | — | — | 0.04 |
| Q | 0.04 | 0.10 | 1.50 | 0.006 | 0.001 | 0.018 | 0.0029 | 0.0023 | — | — | — | 0.06 | 0.06 |

| Steel | Chemical composition (wt. %) | | | | | $Ac_1$ | $Ac_3$ | |
|---|---|---|---|---|---|---|---|---|
| No. | Nb | Ti | B | Ca | REM | ° C. | ° C. | None |
| M | 0.05 | 0.011 | — | — | — | 770 | 895 | Invention |
| N | 0.02 | 0.007 | 0.0011 | — | — | 760 | 890 | Invention |
| O | 0.03 | 0.009 | — | 0.002 | — | 770 | 900 | Invention |
| P | 0.03 | 0.009 | — | — | 0.007 | 765 | 900 | Invention |
| Q | 0.04 | — | — | — | — | 770 | 885 | Invention |

TABLE 6

| | | Base steel pipe | | Conditions of reduction rolling | | | | | | |
|---|---|---|---|---|---|---|---|---|---|---|
| No. | Steel No. | Type | Outer diameter mm | Heating temp. ° C. | Temp. of starting rolling ° C. | Temp. of finishing rolling ° C. | Cumulative reduction ratio % | Total No. of pass | No. of pass 6% or more | Outer diameter of pipe product mm |
| 3-1 | M | Seam welded steel pipe | 110 | 720 | 700 | 680 | 45 | 10 | 7 | 60.5 |
| 3-2 | | | | 660 | 650 | 640 | 45 | 10 | 7 | 60.5 |
| 3-3 | | | | 610 | 600 | 590 | 45 | 10 | 7 | 60.5 |
| 3-4 | | | | 660 | 650 | 640 | 8 | 3 | 1 | 101.6 |
| 3-5 | N | | | 660 | 650 | 640 | 45 | 10 | 7 | 60.5 |
| 3-6 | O | | | 720 | 700 | 690 | 69 | 17 | 15 | 34.1 |
| 3-7 | | | | 800 | 780 | 770 | 69 | 17 | 15 | 34.1 |
| 3-8 | | | | 850 | 830 | 820 | 69 | 17 | 15 | 34.1 |
| 3-9 | | | | 950 | 920 | 900 | 69 | 17 | 15 | 34.1 |
| 3-10 | P | | | 720 | 690 | 650 | 69 | 17 | 15 | 34.1 |
| 3-11 | | | | 950 | 920 | 900 | 69 | 17 | 15 | 34.1 |
| 3-12 | Q | | | 720 | 700 | 680 | 77 | 24 | 18 | 25.4 |

| | | Characteristics of pipe product | | | | | | | | | | | |
|---|---|---|---|---|---|---|---|---|---|---|---|---|---|
| No. | Steel No. | Yield strength*** MPa | Tensile strength TS MPa | Elongation El % | High speed tensile strength MPa | Collision impact absorption energy MJ · $m^{-3}$ | Presence of SSC resistant cracks*** | | Ferrite grain diameter μm | Area ratio of second phase % | Type of second phase* | Miscell-aneous | Note |
| 3-1 | M | 507 | 616 | 41 | 786 | 258 | ○ | ○ | 2.0 | 5 | C | | Invention |
| 3-2 | | 565 | 642 | 38 | 838 | 275 | ○ | ○ | 1.5 | 5 | C | | Invention |
| 3-3 | | 616 | 692 | 35 | 906 | 293 | ○ | ○ | 2.0 | 5 | C | | Invention |
| 3-4 | | 506 | 582 | 43 | 761 | 199 | ○ | × | 10.0 | 5 | C | | Comparative |
| 3-5 | N | 637 | 724 | 35 | 943 | 307 | ○ | ○ | 2.0 | 20 | C | | Invention |
| 3-6 | O | 560 | 625 | 42 | 815 | 270 | ○ | ○ | 2.5 | 5 | C | | Invention |
| 3-7 | | 538 | 611 | 43 | 772 | 250 | ○ | ○ | 2.0 | 5 | C | | Invention |
| 3-8 | | 521 | 593 | 45 | 733 | 230 | ○ | ○ | 2.5 | 5 | C | | Invention |
| 3-9 | | 431 | 538 | 39 | 668 | 180 | × | ○ | 6.0 | 8 | C + B | | Comparative |
| 3-10 | P | 582 | 640 | 40 | 830 | 273 | ○ | ○ | 1.5 | 5 | C | | Invention |
| 3-11 | | 445 | 550 | 39 | 678 | 180 | × | × | 6.5 | 7 | C + B | | Comparative |
| 3-12 | Q | 600 | 658 | 38 | 861 | 279 | ○ | ○ | 1.5 | 5 | C | | Invention |

Note)
*C: Cementite, B: Bainite, M: Martensite, P: Pearlite
**Without reduction rolling
***0.2% PS
****No breakage ○ , breakage ×

TABLE 7

| Steel No. | Chemical composition (wt. %) C | Si | Mn | P | S | Al | N | O | Cu | Ni | Cr | Mo | V |
|---|---|---|---|---|---|---|---|---|---|---|---|---|---|
| R | 0.09 | 0.02 | 0.73 | 0.011 | 0.003 | 0.032 | 0.0036 | 0.0025 | — | — | — | — | — |
| S | 0.11 | 0.15 | 1.28 | 0.007 | 0.001 | 0.028 | 0.0041 | 0.0025 | 0.12 | 0.18 | 0.15 | — | — |
| T | 0.14 | 0.35 | 0.91 | 0.008 | 0.001 | 0.025 | 0.0038 | 0.0033 | — | — | — | — | 0.02 |
| U | 0.12 | 0.25 | 1.36 | 0.008 | 0.001 | 0.028 | 0.0030 | 0.0028 | — | — | — | — | — |
| V | 0.21 | 0.20 | 0.48 | 0.009 | 0.001 | 0.025 | 0.0038 | 0.0031 | 0.12 | 0.12 | 0.11 | 0.05 | 0.02 |

| Steel No. | Chemical composition (wt. %) Nb | Ti | B | Ca | REM | $Ac_1$ ° C. | $Ac_3$ ° C. | Note |
|---|---|---|---|---|---|---|---|---|
| R | — | — | — | — | — | 770 | 880 | Invention |
| S | — | — | — | — | — | 755 | 850 | Invention |
| T | 0.021 | 0.007 | 0.0011 | — | — | 770 | 870 | Invention |
| U | — | — | — | 0.003 | — | 760 | 865 | Invention |
| V | 0.009 | 0.009 | — | — | 0.006 | 765 | 840 | Invention |

TABLE 8

| No. | Steel No. | Base steel pipe: Type | Outer diameter mm | Conditions of reduction rolling: Heating temp. ° C. | Temp. of starting rolling ° C. | Temp. of finishing rolling ° C. | Cumulative reduction ratio % | Total No. of pass | No. of pass 6% or more | Outer diameter of pipe product mm |
|---|---|---|---|---|---|---|---|---|---|---|
| 4-1 | R | Seam welded | 110 | 660 | 650 | 630 | 68 | 14 | 9 | 35.0 |
| 4-2 | | steel pipe | 35.0 | | | —** | | | 9 | 35.0 |
| 4-3 | S | | 110 | 605 | 600 | 590 | 68 | 14 | 9 | 35.0 |
| 4-4 | | | | 880 | 860 | 830 | 68 | 14 | 9 | 35.0 |
| 4-5 | | | | 660 | 650 | 640 | 18 | 4 | 2 | 90.0 |
| 4-6 | | | | 700 | 690 | 670 | 77 | 17 | 10 | 25.6 |
| 4-7 | T | Seamless steel | 110 | 660 | 650 | 630 | 77 | 17 | 10 | 25.6 |
| 4-8 | U | pipe | | 660 | 650 | 630 | 77 | 17 | 10 | 25.6 |
| 4-9 | V | | | 660 | 650 | 630 | 77 | 17 | 10 | 25.6 |

| No. | Steel No. | Characteristics of pipe product: Yield strength*** MPa | Tensile strength TS MPa | Elongation El % | High speed tensile strength MPa | Collision impact absorbed energy $MJ \cdot m^{-3}$ | Fatigue strength**** MPa | Ferrite grain diameter $\mu m$ | Area ratio of second phase % | Type of second phase** | Note |
|---|---|---|---|---|---|---|---|---|---|---|---|
| 4-1 | R | 466 | 550 | 47 | 742 | 198 | 220 | 1.5 | 14 | C | Invention |
| 4-2 | | 364 | 448 | 45 | 553 | 124 | 140 | 13.0 | 15 | C | Comparative |
| 4-3 | S | 531 | 612 | 40 | 821 | 223 | 250 | 1.5 | 18 | C | Invention |
| 4-4 | | 421 | 517 | 38 | 648 | 143 | 155 | 8.0 | 16 | C + B | Comparative |
| 4-5 | | 451 | 522 | 36 | 679 | 151 | 160 | 9.0 | 18 | C | Comparative |
| 4-6 | | 525 | 575 | 42 | 761 | 255 | 250 | 0.9 | 18 | C | Invention |
| 4-7 | T | 507 | 596 | 40 | 795 | 196 | 235 | 2.0 | 16 | C | Invention |
| 4-8 | U | 523 | 618 | 39 | 806 | 198 | 240 | 2.5 | 20 | C | Invention |
| 4-9 | V | 570 | 657 | 37 | 850 | 210 | 255 | 2.0 | 23 | C | Invention |

Note)
*C: Cementite, B: Bainite, M: Martensite, P: Pearlite
**Without reduction rolling
***0.2% PS
****Load stress for $10^6$ endurance cycles

TABLE 9

| Steel No. | Chemical composition (wt. %) C | Si | Mn | P | S | Al | N |
|---|---|---|---|---|---|---|---|
| A1 | 0.06 | 0.05 | 0.35 | 0.018 | 0.019 | 0.028 | 0.0025 |
| B1 | 0.25 | 0.20 | 0.82 | 0.012 | 0.007 | 0.010 | 0.0028 |

TABLE 10

| No. | Steel No. | Outer diameter of base pipe mm | Crystal grain diameter of base pipe μm | Base steel pipe $Ac_1$ ° C. | Base steel pipe $Ac_3$ ° C. | Conditions of reduction rolling: Heating temp. ° C. | Temp. of starting rolling ° C. | Temp. of finishing rolling ° C. | Av. rolling temp. ° C. | Outer diameter of pipe product mm | Total reduction ratio % | Equation (1) Left side | Equation (1) Right side |
|---|---|---|---|---|---|---|---|---|---|---|---|---|---|
| 5-1 | A1 | 88.0 | 3.8 | 770 | 900 | 400 | 395 | 412 | 404 | 42.7 | 51.5 | 3.8 | 9.67 |
| 5-2 | | | | | | 450 | 445 | 458 | 452 | 60.3 | 31.5 | 3.8 | 4.45 |
| 5-3 | | | | | | 670 | 660 | 641 | 651 | 60.3 | 31.5 | 3.8 | 3.20 |
| 5-4 | | | | | | 670 | 660 | 638 | 649 | 42.7 | 51.5 | 3.8 | 8.45 |
| 5-5 | | | | | | 810 | 775 | 748 | 762 | 42.7 | 51.5 | 3.8 | 5.74 |
| 5-6 | | | 8.2 | | | 450 | 445 | 462 | 454 | 42.7 | 51.5 | 8.2 | 9.75 |
| 5-7 | | | | | | 600 | 590 | 592 | 591 | 42.7 | 51.5 | 8.2 | 9.19 |
| 5-8 | | | | | | 670 | 660 | 639 | 650 | 60.3 | 31.5 | 8.2 | 3.21 |
| 5-9 | | | | | | 670 | 660 | 636 | 548 | 42.7 | 51.5 | 8.2 | 8.47 |
| 5-10 | | | | | | 735 | 720 | 702 | 711 | 31.8 | 63.9 | 8.2 | 13.57 |
| 5-11 | | | | | | 780 | 760 | 737 | 749 | 31.8 | 63.9 | 8.2 | 11.85 |
| 5-12 | | | 13.1 | | | 450 | 445 | 458 | 452 | 42.7 | 51.5 | 13.1 | 9.75 |
| 5-13 | | | | | | 445 | 440 | 466 | 453 | 31.8 | 63.9 | 13.1 | 15.86 |

| No. | Steel No. | Characteristics of pipe product: Crystal grain diameter μm | Yield strength YS MPa | Tensile strength TS MPa | Elongation (EL) % | Real pipe Charpy ductile rupture ratio % | Structure* | Area ratio of second phase % | Note |
|---|---|---|---|---|---|---|---|---|---|
| 5-1 | A1 | Breakage occurred during rolling | | | | | | | Comparative |
| 5-2 | | 0.92 | 613 | 648 | 41 | 90 | F + P | P: 8 | Invention |
| 5-3 | | 2.25 | 496 | 538 | 32 | 40 | F + C | C: 6 | Comparative |
| 5-4 | | 0.55 | 431 | 518 | 48 | 100 | F + C | C: 6 | Invention |
| 5-5 | | 0.99 | 415 | 448 | 38 | 75 | F + B | B: 8 | Invention |
| 5-6 | | 0.95 | 552 | 597 | 41 | 90 | F + P | P: 8 | Invention |
| 5-7 | | 0.81 | 451 | 502 | 44 | 95 | F + P | P: 6 | Invention |
| 5-8 | | 5.12 | 451 | 485 | 28 | 0 | F + C | C: 5 | Comparative |
| 5-9 | | 0.68 | 439 | 506 | 46 | 100 | F + C | C: 5 | Invention |
| 5-10 | | 0.78 | 448 | 496 | 44 | 95 | F + B | B: 8 | Invention |
| 5-11 | | 0.90 | 413 | 462 | 43 | 90 | F + B | B: 8 | Invention |
| 5-12 | | 6.92 | 560 | 574 | 23 | 0 | F + P | P: 8 | Comparative |
| 5-13 | | 0.96 | 607 | 658 | 42 | 90 | F + P | P: 8 | Invention |

*F represents ferrite, P represents pearlite (inclusive of pseudo-pearlite), C represents cementite, and B represents bainite.

TABLE 11

| No. | Steel No. | Outer diameter of base pipe mm | Crystal grain diameter of base pipe μm | Base steel pipe $Ac_1$ ° C. | Base steel pipe $Ac_3$ ° C. | Conditions of reduction rolling: Heating temp. ° C. | Temp. of starting rolling ° C. | Temp. of finishing rolling ° C. | Av. rolling temp. ° C. | Outer diameter of pipe product mm | Total reduction ratio % | Equation (1) Left side | Equation (1) Right side |
|---|---|---|---|---|---|---|---|---|---|---|---|---|---|
| 6-1 | B1 | 110.0 | 6.3 | 765 | 830 | 625 | 615 | 591 | 603 | 60.3 | 45.2 | 6.3 | 6.78 |
| 6-2 | | | | | | 735 | 720 | 690 | 705 | 60.3 | 45.2 | 6.3 | 5.33 |
| 6-3 | | | | | | 735 | 720 | 684 | 702 | 42.7 | 61.2 | 6.3 | 12.14 |
| 6-4 | | | 15.2 | | | 560 | 550 | 553 | 552 | 42.7 | 61.2 | 15.2 | 14.53 |
| 6-5 | | | | | | 675 | 665 | 640 | 653 | 42.7 | 61.2 | 15.2 | 3.44 |
| 6-6 | | | | | | 680 | 670 | 637 | 654 | 31.8 | 71.1 | 15.2 | 21.70 |
| 6-7 | | | | | | 785 | 765 | 726 | 746 | 31.8 | 71.1 | 15.2 | 17.59 |
| 6-8 | | | 28.1 | | | 680 | 670 | 637 | 654 | 31.8 | 71.1 | 28.1 | 21.70 |
| 6-9 | | | | | | 680 | 675 | 634 | 655 | 25.4 | 76.9 | 28.1 | 28.75 |

| No. | Steel No. | Characteristics of pipe product: Crystal grain diameter μm | Yield popint YS MPa | Tensile strength TS MPa | Elongation (EL) % | Real pipe Charpy ductile rupture ratio % | Structure* | Area ratio of second phase % | Note |
|---|---|---|---|---|---|---|---|---|---|
| 6-1 | B1 | 0.82 | 589 | 660 | 42 | 95 | F + P | P: 23 | Invention |
| 6-2 | | 2.13 | 486 | 532 | 37 | 20 | F + B | B: 25 | Comparative |
| 6-3 | | 0.91 | 513 | 588 | 43 | 90 | F + B | B: 20 | Invention |
| 6-4 | | 2.36 | 601 | 643 | 41 | 20 | F + P | P: 23 | Comparative |
| 6-5 | | 3.22 | 564 | 602 | 34 | 10 | F + C | C: 16 | Comparative |
| 6-6 | | 0.57 | 592 | 671 | 44 | 100 | F + C | C: 16 | Invention |
| 6-7 | | 0.88 | 568 | 623 | 46 | 90 | F + B | B: 23 | Invention |

TABLE 11-continued

| | | | | | | | |
|---|---|---|---|---|---|---|---|
| 6-8 | 4.96 | 596 | 642 | 24 | 0 | F + C | C: 18 | Comparative |
| 6-9 | 0.69 | 638 | 711 | 42 | 100 | F + C | C: 18 | Invention |

*F represents ferrite, P represents pearlite (inclusive of pseudo-pearlite), C represents cementite, and B represents bainite.

TABLE 12

| Steel | Chemical composition (wt. %) | | | | | | | | | | | | | | | | |
|---|---|---|---|---|---|---|---|---|---|---|---|---|---|---|---|---|---|
| No. | C | Si | Mn | P | S | Al | N | Cu | Ni | Cr | Mo | V | Nb | Ti | B | Ca | REM |
| C1 | 0.09 | 0.40 | 0.80 | 0.012 | 0.005 | 0.035 | 0.0035 | — | — | — | — | — | — | — | — | — | — |
| D1 | 0.21 | 0.20 | 0.50 | 0.016 | 0.013 | 0.024 | 0.0043 | — | — | — | — | — | — | — | — | — | — |
| E1 | 0.15 | 0.21 | 0.55 | 0.009 | 0.004 | 0.010 | 0.0028 | — | — | 0.21 | 0.53 | — | — | — | — | — | — |
| F1 | 0.15 | 0.22 | 0.45 | 0.018 | 0.003 | 0.031 | 0.0036 | 0.11 | 0.15 | -. | — | — | — | — | — | 0.002 | — |
| G1 | 0.08 | 0.04 | 1.35 | 0.015 | 0.011 | 0.036 | 0.0041 | — | — | — | — | 0.10 | — | — | — | 0.002 | — |
| H1 | 0.05 | 1.01 | 1.35 | 0.012 | 0.001 | 0.035 | 0.0030 | — | — | — | — | — | 0.015 | 0.011 | 0.0023 | — | — |
| I1 | 0.14 | 0.30 | 1.30 | 0.011 | 0.003 | 0.028 | 0.0038 | 0.20 | 0.25 | — | — | — | — | — | — | — | 0.008 |

TABLE 13

| | | Base steel pipe | | | | | Conditions of reduction rolling | | | | | | | |
|---|---|---|---|---|---|---|---|---|---|---|---|---|---|---|
| | | | | | | | | | | | | | Equation (1) | |
| No. | Steel No. | Type | Outer diameter mm | Crystal grain diameter μm | $Ac_1$ ° C. | $Ac_3$ ° C. | Heating temp. ° C. | Temp. of starting rolling ° C. | Temp. of finishing rolling ° C. | Av. rolling temp. ° C. | Outer diameter of pipe product mm | Total reduction ratio % | Left side | Right side |
| 7-1 | C1 | Solid phase pressure welded pipe | 88.0 | 6.3 | 770 | 895 | 450 | 443 | 460 | 452 | 60.3 | 31.5 | 3.8 | 4.45 |
| 7-2 | | | | 8.2 | | | 600 | 589 | 593 | 591 | 42.7 | 51.5 | 6.2 | 9.19 |
| 7-3 | D1 | | | 13.1 | 760 | 850 | 445 | 437 | 469 | 453 | 31.8 | 63.9 | 13.1 | 15.86 |
| 7-4 | | | | 13.1 | | | 690 | 670 | 620 | 650 | 42.7 | 51.4 | 6.3 | 6.81 |
| 7-5 | E1 | Seam-less steel pipe | 110.0 | 6.3 | 785 | 880 | 625 | 610 | 596 | 603 | 60.3 | 45.2 | 6.3 | 6.78 |
| 7-6 | | | | 15.2 | | | 785 | 762 | 730 | 746 | 31.8 | 71.1 | 15.2 | 17.59 |
| 7-7 | F1 | | | 8.2 | 780 | 860 | 705 | 700 | 682 | 691 | 25.4 | 76.9 | 8.2 | 9.19 |
| 7-8 | G1 | Solid phase pressure welded pipe | 42.7 | 3.8 | 755 | 875 | 700 | 670 | 620 | 645 | 25.4 | 40.5 | 3.8 | 5.02 |
| 7-9 | | | | 6.7 | | | 610 | 595 | 588 | 592 | 15.1 | 64.6 | 6.7 | 9.19 |
| 7-10 | H1 | Seam welded steel pipe | | 5.5 | 775 | 900 | 720 | 690 | 653 | 672 | 15.1 | 64.6 | 5.5 | 9.19 |
| 7-11 | I1 | Solid phase pressure welded pipe | 88.0 | 7.7 | 750 | 860 | 675 | 665 | 642 | 654 | 42.7 | 51.5 | 7.7 | 9.19 |

| | | Characteristics of pipe product | | | | | | | |
|---|---|---|---|---|---|---|---|---|---|
| No. | Steel No. | Crystal grain diameter μm | Yield Strength YS MPa | Tensile strength TS MPa | Elongation (EL) % | Real pipe Charpy ductile rupture ratio % | Structure* | Area ratio of second phase % | Note |
| 7-1 | C1 | 0.87 | 632 | 665 | 44 | 100 | F + P | P: 15 | Invention |
| 7-2 | | 0.77 | 531 | 580 | 51 | 100 | F + P | P: 15 | Invention |
| 7-3 | D1 | 0.92 | 661 | 692 | 42 | 95 | F + P +B | PB: 22 | Invention |
| 7-4 | | 0.75 | 511 | 548 | 49 | 100 | F + P + B | PB: 22 | Invention |
| 7-5 | E1 | 0.80 | 688 | 713 | 37 | 100 | F + P + B | PB: 25 | Invention |
| 7-6 | | 0.85 | 588 | 630 | 40 | 95 | F + P + B | PB: 25 | Invention |
| 7-7 | F1 | 0.95 | 559 | 601 | 47 | 100 | F + C | C: 11 | Invention |
| 7-8 | G1 | 0.95 | 526 | 572 | 44 | 100 | F + C | C: 10 | Invention |
| 7-9 | | 0.91 | 535 | 581 | 48 | 100 | F + C | C: 10 | Invention |
| 7-10 | H1 | 0.88 | 688 | 736 | 38 | 95 | F + M | M: 15 | Invention |
| 7-11 | I1 | 0.85 | 463 | 523 | 46 | 100 | F + C | C: 14 | Invention |

*F represents ferrite, P represents pearlite (inclusive of pseudo-pearlite), C represents cementite, and B represents bainite.

TABLE 14

| Steel No. | Chemical composition (wt. %) C | Si | Mn | P | S | Al |
|---|---|---|---|---|---|---|
| A | 0.43 | 0.32 | 1.53 | 0.008 | 0.003 | 0.015 |
| B | 0.53 | 0.21 | 0.55 | 0.011 | 0.004 | 0.025 |
| C | 0.35 | 0.35 | 1.31 | 0.013 | 0.003 | 0.031 |
| D | 0.33 | 0.35 | 0.86 | 0.012 | 0.003 | 0.022 |

TABLE 15

| | | Base steel pipe | | | Conditions of reduction rolling | | | | | | | |
|---|---|---|---|---|---|---|---|---|---|---|---|---|
| No. | Steel No. | Outer diameter mm | Crystal grain diameter μm | Structure* | Heating temp. ° C. | Temp. of starting rolling ° C. | Temp. of finishing rolling ° C. | Av. rolling temp. ° C. | Outer diameter of pipe product mm | Total reduction ratio % | Equation (1) Left side | Equation (1) Right side |
| 1-1 | A | 110 | 6 | F + P | 900 | 880 | 850 | 865 | 42.7 | 61 | 6 | 1.9 |
| 1-2 | | | | | 750 | 730 | 700 | 715 | 42.7 | 61 | 6 | 12 |
| 1-3 | | | | | 750 | 730 | 700 | 715 | 60.3 | 45 | 6 | 5.1 |
| 1-4 | | | | | 580 | 570 | 550 | 560 | 60.3 | 45 | 6 | 7.1 |
| 1-5 | B | 110 | 9 | F + P | 700 | 680 | 650 | 665 | 42.7 | 61 | 9 | 13 |
| 1-6 | | | | | 620 | 610 | 590 | 600 | 42.7 | 61 | 9 | 14 |
| 1-7 | C | 110 | 12 | F + P | 620 | 610 | 590 | 600 | 42.7 | 61 | 12 | 14 |
| 1-8 | | | | | 800 | 790 | 760 | 775 | 42.7 | 61 | 12 | 8.9 |
| 1-9 | D | 110 | 12 | F + P | 900 | 880 | 850 | 865 | 42.7 | 61 | 12 | 1.9 |
| 1-10 | | | | | 620 | 610 | 590 | 600 | 42.7 | 61 | 12 | 14 |

| | | Characteristics of pipe product | | | | | | |
|---|---|---|---|---|---|---|---|---|
| | | Crystal grain | Yield Strength | Tensile strength | Elongation | Structure of Second phase | | |
| No. | Steel No. | diameter μm | YS** MPa | TS MPa | (EL) % | * | Area ratio % | Note |
| 1-1 | A | 7.5 | 504 | 641 | 37 | P | 65 | Comparative |
| 1-2 | | 1.0 | 624 | 721 | 39 | C | 60 | Invention |
| 1-3 | | 4.5 | 540 | 641 | 35 | C, P | 60 | Comparative |
| 1-4 | | 1.5 | 685 | 773 | 37 | C | 60 | Invention |
| 1-5 | B | 1.5 | 660 | 759 | 40 | C | 65 | Invention |
| 1-6 | | 1.0 | 687 | 782 | 38 | C | 65 | Invention |
| 1-7 | C | 1.5 | 610 | 700 | 40 | C | 40 | Invention |
| 1-8 | | 8.0 | 520 | 618 | 37 | C, P | 40 | Comparative |
| 1-9 | D | 15 | 444 | 563 | 42 | P | 40 | Comparative |
| 1-10 | | 1.5 | 553 | 633 | 43 | C | 35 | Invention |

*F represents ferrite, P represents (inclusive of pseudo-pearlite), C represents cementite, and B represents bainite.
**0.2% PS

TABLE 16

| Steel No. | Chemical composition (wt. %) C | Si | Mn | P | S | Al | N | Cu | Ni | Cr | Mo | V | Nb | Ti | B | Ca | REM | O |
|---|---|---|---|---|---|---|---|---|---|---|---|---|---|---|---|---|---|---|
| E | 0.45 | 0.25 | 0.81 | 0.009 | 0.004 | 0.015 | 0.0028 | 0.15 | 0.20 | 0.12 | 0.08 | — | — | — | — | — | — | 0.0023 |
| F | 0.36 | 0.26 | 0.97 | 0.008 | 0.003 | 0.021 | 0.0032 | — | — | — | — | 0.08 | 0.02 | 0.02 | 0.009 | — | — | 0.0019 |
| G | 0.48 | 0.25 | 0.78 | 0.014 | 0.006 | 0.018 | 0.0035 | — | — | — | — | — | — | — | — | 0.002 | 0.004 | 0.0023 |
| H | 0.35 | 0.25 | 1.35 | 0.012 | 0.002 | 0.015 | 0.0036 | 0.12 | 0.10 | 0.10 | 0.05 | 0.05 | 0.01 | 0.01 | 0.001 | 0.002 | — | 0.0022 |
| I | 0.33 | 0.15 | 0.51 | 0.013 | 0.004 | 0.028 | 0.0043 | 0.15 | 0.20 | — | — | — | 0.01 | 0.01 | — | — | — | 0.0025 |
| J | 0.32 | 0.15 | 0.53 | 0.011 | 0.003 | 0.036 | 0.0039 | — | — | — | 0.20 | 0.10 | — | — | — | — | — | 0.0021 |
| K | 0.09 | 0.02 | 0.73 | 0.011 | 0.003 | 0.032 | 0.0036 | — | — | — | — | — | — | — | — | — | — | 0.0025 |
| L | 0.08 | 0.21 | 0.58 | 0.016 | 0.004 | 0.029 | 0.0045 | — | — | — | — | — | 0.01 | 0.01 | — | — | — | 0.0019 |

TABLE 17

| | | Base steel pipe | | | Conditions of reduction rolling | | | | | | | |
|---|---|---|---|---|---|---|---|---|---|---|---|---|
| | | Outer | Crystal grain | | Heating | Temp. of starting | Temp. of | Av. rolling | Outer diameter | Total reduction | Equation (1) | |
| No. | Steel No. | diameter mm | diameter μm | Structure* | temp. ° C. | rolling ° C. | finishing rolling ° C. | temp. ° C. | of pipe product mm | ratio % | Left side | Right side |
| 2-1 | E | 110 | 11 | F + P | 670 | 660 | 630 | 645 | 42.7 | 61 | 11 | 13.6 |
| 2-2 | F | | 7 | | | | | | | | 7 | |
| 2-3 | G | | 10 | | | | | | | | 10 | |
| 2-4 | H | | 8 | | | | | | | | 8 | |
| 2-5 | I | | 11 | | | | | | | | 11 | |
| 2-6 | J | | 10 | | | | | | | | 10 | |
| 2-7 | K | | 12 | | | | | | | | 12 | |
| 2-8 | L | | 11 | | | | | | | | 11 | |

| | | Characteristics of pipe product | | | | | | |
|---|---|---|---|---|---|---|---|---|
| | | Crystal grain | Yield Strength | Tensile strength | Elongation | Structure of Second phase | | |
| No. | Steel No. | diameter μm | YS** MPa | TS MPa | (EL) % | * | Area ratio % | Note |
| 2-1 | E | 1.5 | 659 | 761 | 39 | C | 65 | Invention |
| 2-2 | F | 1.5 | 667 | 753 | 40 | | 45 | Invention |
| 2-3 | G | 1.5 | 623 | 739 | 40 | | 65 | Invention |
| 2-4 | H | 1.0 | 701 | 796 | 38 | | 45 | Invention |
| 2-5 | I | 1.5 | 603 | 678 | 42 | | 40 | Invention |
| 2-6 | J | 1.5 | 622 | 708 | 41 | | 35 | Invention |
| 2-7 | K | 2.5 | 469 | 539 | 45 | | 11 | Comparative |
| 2-8 | L | 2.0 | 446 | 530 | 43 | | 8 | Comparative |

*F represents ferrite, P represents pearlite (inclusive of pseudo-pearlite), C represents cementite, and B represents bainite.
**0.2% PS

APPLICABILITY IN INDUSTRY

In accordance with the present invention, high strength steel pipes having excellent ductility and impact resistance properties can be obtained with high productivity and by a simple process. Thus, the present invention extends the application field of steel pipes and is therefore particularly effective in the industry. Furthermore, the present invention reduces the use of alloy elements and enables low cost production of high-strength high-ductility steel pipes improved in fatigue resistance properties, or high-strength high-toughness steel pipes for use in line pipes improved in stress corrosion crack resistance. Moreover, a high strength steel material containing super fine crystal grains 1 μm or less in size is produced with superior in toughness and ductility, thereby expanding the use of steel materials.

Also available easily and without applying intermediate annealing is a steel material containing super fine crystal grains 2 μm or less in size, which yields a tensile strength of 600 MPa or more, and excellent toughness and ductility.

What is claimed is:

1. A method for producing a steel pipe which comprises heating or soaking a base steel pipe having an outer diameter of ODi (mm) and having ferrite grains with an average crystal diameter of di (μm) in the cross section perpendicular to the longitudinal direction of the steel pipe, followed by reducing by drawing at an average rolling temperature of θm (°C.) and a total reduction ratio Tred (%) to obtain a product pipe having an outer diameter of ODf (mm), said reducing comprises performing it in the temperature range of 400° C. or more but not more than the heating or soaking temperature, and in such a manner that said average crystal diameter of di (μm), said average rolling temperature of θm (°C.), and said total reduction ratio T red (%) are in a relation satisfying equation (1) as follows:

$$di \leqq (2.65-0.003\times\theta m)\times 10^{\{(0.008+\theta m/50000)\times Tred\}} \quad (1)$$

where, di represents the average crystal diameter of the base steel pipe (μm); θm represents the average rolling temperature (°C.) (=(θ i+θ f)/2, where θ i is the temperature of starting rolling (°C.), and θ f is the temperature of finishing rolling (°C.)); and T red represents the total reduction ratio (%) (=ODi−ODf)×100/ODi, where ODi is the outer diameter of the base steel pipe (mm), and ODf is the outer diameter of the product pipe (mm)).

2. The method for producing a steel pipe as claimed in claim 1, wherein the cross section perpendicular to the longitudinal direction of the steel pipe after reducing contains super fine grains of ferrite having an average crystal grain size of 1 μm or less.

3. The method for producing a steel pipe as claimed in claim 1, wherein the structure of the steel pipe after reducing consists of ferrite alone or ferrite together with a second phase other than ferrite accounting for 30% or less in area ratio, and the cross section perpendicular to the longitudinal direction of the steel pipe after reducing contains super fine grains of said ferrite having an average crystal grain size of 3 μm or less.

4. The method for producing a steel pipe as claimed in claim 1, wherein the structure of the steel pipe after reducing consists of ferrite alone or ferrite together with a second phase other than ferrite accounting for 30% or less in area ratio, and the cross section perpendicular to the longitudinal direction of the steel pipe after reducing contains super fine grains of said ferrite having an average crystal grain size of 1 μm or less.

5. The method for producing a steel pipe as claimed in claim 1, wherein the structure of the steel pipe after reducing consists of ferrite together with a second phase other than ferrite accounting for more than 30% in area ratio, and the cross section perpendicular to the longitudinal direction of the steel pipe after drawing contains super fine grains of said ferrite having an average crystal grain size of 2 $\mu$m or less.

6. The method for producing a steel pipe as claimed in claim 1, wherein the structure of the steel pipe after reducing consists of ferrite together with a second phase other than ferrite accounting for more than 30% in area ratio, and the cross section perpendicular to the longitudinal direction of the steel pipe after drawing contains super fine grains of said ferrite having an average crystal grain size of 1 $\mu$m or less.

7. The method for producing a steel pipe as claimed in claim 1 wherein, drawing is performed in a temperature range of from $Ac_3$ transformation point to 400° C.

8. The method for producing a steel pipe as claimed in any claim 1 wherein, the method comprises heating the base steel pipe in the temperature range of from $Ac_3$ transformation point to 400° C. before reducing, and then performing reducing in a temperature range of from $Ac_3$ transformation point to 400° C.

9. The method for producing a steel pipe as claimed in claim 1 wherein, the method comprises heating the base steel pipe in the temperature range of from 400° C. to 750° C. before reducing, and then performing reducing in a temperature range of 400° C. to 750° C.

10. The method for producing a steel pipe as claimed in claim 1, wherein the reducing is performed under lubrication.

11. The method for producing a steel pipe as claimed in claim 1, wherein the method comprises at least one rolling pass with a reduction ratio per pass of 6% or more.

12. The method for producing a steel pipe as claimed in claim 1, wherein the cumulative reduction ratio in drawing is 60% or more.

13. The method for producing a steel pipe as claimed in claim 1, wherein the reducing is performed on a base steel pipe containing, by weight, 0.005 to 0.30% C, 0.01 to 3.0% Si, 0.01 to 2.0% Mn, 0.001 to 0.10% Al, and balance Fe with unavoidable impurities.

14. The method for producing a steel pipe as claimed in claim 1, wherein the drawing is performed on a base steel pipe containing, by weight, 0.005 to 0.30% C, 0. 01 to 3.0% Si, 0.01 to 2.0% Mn, 0.001 to 0.10% Al, and further containing at least, one or more types selected from the group consisting of 0.5% or less of Cu, 0.5% or less of Ni, 0.5% or less of Cr, and 0.5% or less of Mo; or furthermore one or more selected from the group consisting of 0.1% or less of Nb, 0.1% or less of V, 0.1% or less of Ti, and 0.004% or less of B; or further additionally, one or more selected from the group consisting of 0.02% or less of REM and 0.01% or less of Ca; and balance Fe with unavoidable impurities.

15. The method for producing a steel pipe as claimed in claim 1 the wherein, drawing is performed on a base steel pipe containing, by weight, more than 0.30% to 0.70% C, 0.01 to 2.0% Si, 0.01 to 2.0% Mn, 0.001 to 0.10% Al, and balance Fe with unavoidable impurities.

16. The method for producing a steel pipe as claimed in claim 1, wherein the drawing is performed on a base steel pipe containing, by weight, more than 0.30% to 0.70% C, 0.01 to 2.0% Si, 0.01 to 2.0% Mn, 0.001 to 0.10% Al, and further containing at least, one or more types selected from the group consisting of 0.5% or less of Cu, 0.5% or less of Ni, 0.5% or less of Cr, and 0.5% or less of Mo; or furthermore one or more selected from the group consisting of 0.1% or less of Nb, 0.1% or less of V, 0.1% or less of Ti, and 0.004% or less of B; or further additionally, one or more selected from the group consisting of 0.02% or less of REM and 0.01% or less of Ca; and balance Fe with unavoidable impurities.

* * * * *